US011105133B2

(12) United States Patent
Sauve et al.

(10) Patent No.: US 11,105,133 B2
(45) Date of Patent: Aug. 31, 2021

(54) HIGH-SPEED SECTIONAL DOOR

(71) Applicant: Clopay Building Products Company, Inc., Mason, OH (US)

(72) Inventors: Raymond Sauve, Ringgold, GA (US); Muhammad J. Akbar, Cincinnati, OH (US); Daniel V. Jones, Milford, OH (US); Brian M. Magill, Cincinnati, OH (US); James O. Rogers, III, Milford, OH (US)

(73) Assignee: Clopay Building Products Company, Inc., Mason, OH (US)

( * ) Notice: Subject to any disclaimer, the term of this patent is extended or adjusted under 35 U.S.C. 154(b) by 281 days.

(21) Appl. No.: 16/383,724

(22) Filed: Apr. 15, 2019

(65) Prior Publication Data

US 2019/0316399 A1 Oct. 17, 2019

Related U.S. Application Data

(60) Provisional application No. 62/658,636, filed on Apr. 17, 2018.

(51) Int. Cl.
*E06B 9/06* (2006.01)
*E05D 15/24* (2006.01)
*E05D 15/16* (2006.01)

(52) U.S. Cl.
CPC ..... *E05D 15/242* (2013.01); *E05D 15/165* (2013.01); *E05D 15/246* (2013.01); (Continued)

(58) Field of Classification Search
CPC ... E06B 9/0638; E06B 9/0676; E05D 15/242; E05D 15/246; E05D 15/165; E05Y 2900/106
See application file for complete search history.

(56) References Cited

U.S. PATENT DOCUMENTS 955,991 A 4/1910 Pheils
974,327 A 11/1910 Woods
(Continued)

FOREIGN PATENT DOCUMENTS

DE 3735363 A1 6/1988
DE 10213811 A1 10/2003
(Continued)

OTHER PUBLICATIONS

International Searching Authority, International Search Report and Written Opinion, PCT/US2019/027596, dated Jul. 8, 2019, 11 pgs.

*Primary Examiner* — Justin B Rephann
(74) *Attorney, Agent, or Firm* — Wood Herron & Evans LLP

(57) ABSTRACT

A high-speed sectional overhead door covers a door opening with panels stacked in a single plane and lifted from the bottom-most panel. As panels are lifted, each rolls in its own individual track. As the panels move into the head area, they run through curved tracks and are nested there. The stored panels stacked horizontally one atop another with the door open. This design utilizes a dedicated panel-track pairing as well as a unique hook/cam device which allows for the upper panel to be both locked in the closed position and pushed away for separation and storage in the open position. The design also provides a sectional door with low headroom clearance, high speed closing/opening and a multitude of panel heights without hinges joining the adjacent panels

27 Claims, 39 Drawing Sheets

(52) U.S. Cl.
CPC ..... *E06B 9/0638* (2013.01); *E06B 9/0676* (2013.01); *E05Y 2900/106* (2013.01)

(56) References Cited

U.S. PATENT DOCUMENTS 1,033,115 A 7/1912 Mowry
1,352,692 A 9/1920 Posson
1,366,212 A 1/1921 Pollard
1,413,354 A 4/1922 Posson
1,628,511 A 5/1927 Petersen
1,743,696 A 1/1930 Vetterlein
1,872,489 A 8/1932 Mitchell
1,929,071 A 10/1933 Levy
2,020,544 A 11/1935 Gill et al.
2,237,800 A 4/1941 Webber
2,672,192 A 3/1954 Goldner
2,729,287 A 1/1956 Goldner
2,897,886 A 8/1959 Pistelli
3,000,437 A 9/1961 Bennett
3,079,989 A * 3/1963 Fentiman ..... E06B 9/0638 160/189
3,103,246 A * 9/1963 Brodsky ..... E06B 9/0676 160/188
3,237,681 A 3/1966 Huse
3,280,888 A 10/1966 Davis
3,304,994 A * 2/1967 Kozak ..... E06B 9/0638 160/202
3,313,338 A * 4/1967 Knight ..... E06B 3/925 160/189
3,348,336 A 10/1967 Hashagen
3,491,400 A 1/1970 Hubbard
3,618,656 A 11/1971 Young
3,738,413 A 6/1973 Frobosilo et al.
3,842,891 A 10/1974 Kinnroth et al.
4,068,699 A 1/1978 Tucker
4,083,148 A 4/1978 Saucier
4,139,042 A 2/1979 Watanabe et al.
4,303,117 A 12/1981 Lindbergh
4,379,478 A 4/1983 Lichy
4,460,030 A 7/1984 Tsunemura et al.
4,538,661 A 9/1985 Henry et al.
4,603,723 A 8/1986 Sugihara
4,662,420 A 5/1987 Hirao
4,787,119 A 11/1988 Furuya
4,838,331 A 6/1989 Kasai
4,853,531 A 8/1989 Rejc
5,022,454 A 6/1991 Kobayashi et al.
5,065,806 A 11/1991 Kondoh
5,072,766 A 12/1991 Kondoh et al.
5,133,398 A 7/1992 Yang et al.
5,172,742 A 12/1992 Iwasaki et al.
D336,023 S 6/1993 Alpers
5,291,686 A 3/1994 Sears et al.
5,685,355 A 11/1997 Cook et al.
5,893,403 A 4/1999 Megens
6,279,640 B1 8/2001 Van Lennep
6,311,757 B1 11/2001 Schuette et al.
6,339,905 B1 1/2002 Craig
6,655,088 B1 12/2003 Hormann
6,860,311 B1 * 3/2005 Minor ..... E05D 15/18 160/193
D616,290 S 5/2010 Sullivan
7,798,198 B2 9/2010 Rejc et al.
7,913,739 B2 3/2011 Rejc et al.
7,918,263 B2 4/2011 Kraeutler
7,950,438 B2 5/2011 Albert
D649,792 S 12/2011 Nosworthy
8,079,399 B2 12/2011 Rejc
8,316,915 B2 11/2012 Drifka et al.
8,327,908 B2 12/2012 Godovalov
8,360,132 B2 1/2013 Drifka
8,371,356 B2 2/2013 Manser
8,468,751 B2 6/2013 Williams
8,684,064 B2 4/2014 Frede
8,869,450 B2 10/2014 Balay et al.
8,899,297 B2 12/2014 Mazej et al.
9,097,053 B2 8/2015 Drifka
9,222,264 B1 * 12/2015 Reid ..... E06B 9/302
D760,580 S 7/2016 Pace et al.
D764,258 S 8/2016 Miller
D801,788 S 11/2017 Dershem
D801,895 S 11/2017 Bowyer et al.
D814,276 S 4/2018 Ressler
D834,931 S 12/2018 Ressler
2006/0016566 A1 1/2006 Kalempa et al.
2006/0175027 A1 8/2006 Langenbach
2010/0024177 A1 2/2010 Hayes et al.
2010/0032105 A1 2/2010 Drifka
2010/0307058 A1 12/2010 Sanke et al.
2010/0319605 A1 12/2010 Petrenko
2011/0005138 A1 1/2011 Drifka et al.
2011/0023364 A1 2/2011 Euteneuer et al.
2011/0240234 A1 10/2011 Jans
2012/0047804 A1 * 3/2012 Talboys ..... E05D 15/20 49/25
2013/0112357 A1 5/2013 Gontarski et al.
2013/0133263 A1 5/2013 Drifka
2013/0152471 A1 6/2013 Drifka et al.
2014/0290878 A1 10/2014 Balay et al.
2016/0066658 A1 3/2016 Breen et al.

FOREIGN PATENT DOCUMENTS

DE 10236648 A1 2/2004
DE 102015100623 B3 5/2016
EP 0232866 A2 8/1987
EP 0367852 A1 5/1990
EP 1233138 A1 8/2002
EP 2557264 A2 2/2013
SI 1948898 T1 4/2010

* cited by examiner

HIGH-SPEED SECTIONAL DOOR

This claims the benefit of U.S. Provisional Patent Application Ser. No. 62/658,636, filed Apr. 17, 2018 and hereby incorporated by reference in its entirety.

BACKGROUND OF THE INVENTION

This invention relates to overhead sectional doors of the type used to close large openings in garages and commercial building, and more particularly, to a high-speed door of this type.

Overhead doors are utilized to provide security and access control in residential, institutional, industrial and commercial buildings. They fall into two general design categories: coiling doors and segmented panel doors. Each have their advantages and disadvantages.

Often times a segmented panel door is better suited for a particular application but cannot be used due to the increased space requirement needed to house the panels once the door is opened. Various attempts have been made to reduce the profile of the opened door, such as stacking the panels.

The stacking design of those known panel stacking doors typically maintain a connection point between the panels such as a hinge, or otherwise link the opened panels, for example, with chains, to support the weight of the panels during opening.

Having to maintain a connection point between the panels presents many disadvantages such as placing limitations on the ease of repair of damaged panels and requiring higher energy consuming operators to open the door. Accordingly, there is still a continuing need for an improved stacking panel overhead door design.

Sectional folding doors are well known in the art and are widely used all over the world. Typically, such a sectional door has a number of rectangular door panels, the total area of which is equal to the area of the aperture that needs to be closed, and the width of which is close to the width of the aperture that needs to be closed. The panel sections are joined to each other at their longitudinal edges with hinges. The door moves on two lateral rails by means of rollers. The rails have three sections—vertical, transitional, and horizontal. When the door is vertical, the sections make a solid panel, closing the aperture. When the door is opening, the sections move up, pass the transitional section, and move into the top horizontal section. When the door is in the horizontal position, it is situated under the ceiling and above the user. The door area remains invariable—the sections of the garage door occupy the same amount of space both in the open and closed positions. Therefore, these types of doors occupy a lot of space when the aperture is open, which may not be practical in many applications.

High-speed industrial doors, which are capable of being rolled up on a shaft or drum to open, have long been used in the storing and staging areas of commercial buildings such as factories and warehouses. Materials handling machinery, such as conveyors and lift trucks are commonly used to transport items to, from, and between storage areas and staging areas such as loading docks. In such applications, as well as others known in the art, the industrial doors are often required to open quickly, such as opening at a rate of approximately 48 inches per second up to 100 inches per second or greater. This speed enhances productivity, cost savings, and safety, especially where cold storage and distribution is involved. Additionally, specific environmental or security requirements may need door speed and sealing integrity to be maintained in either the storing or staging area or both.

Conventional high-speed roll-up door assemblies include a pair of vertically oriented assemblies installed proximate the vertical sides of an opening defining the passageway for people and commercial vehicles and are sometimes called "side columns", or "guide assemblies". The side columns have structures which guide the flexible door panel during opening and closing. These "guides" provide surfaces which engage a vertical marginal edge portion of the moving door panel therein.

Even though the door panel is moved vertically at a relatively fast rate, there are times when the door panel—or a portion of the door assembly itself—is impacted by a vehicle and dislodged from at least one of the guides. The door assembly cannot operate properly until the displaced door panel is reconfigured to be within the door assembly's guides so as to be in its normal operating configuration.

Reconfiguring or "repairing" the door's guiding function after an impact has been the subject of many prior art designs. However, the prior art has only limited or no solutions for restoring or "repairing" of an automatic high speed roll up door in an efficient and economical manner. These difficulties can result in commercial losses due to lost productivity, thermal losses, and loss of environmental integrity on one or both sides of the door. Repairing the door may also tend to damage the door panel or guide assemblies. The repair from such a dislodgement is routinely accomplished through human operator effort and is not automated. The door panel must be moved back to the other side of the opening before being realigned and reinserted within the guides. Returning the door panel to the door-assembly side of the opening can be difficult—perhaps even requiring disassembly of portions of the door assembly—and may incur additional time, and further expose the door panel to more damage.

SUMMARY OF THE INVENTION

These and other shortcomings in the prior art have been addressed by this invention which in various embodiments a high-speed sectional overhead door. Such a door covers opening with panels stacked in a single plane and lifted from the bottom-most panel. As panels are lifted, they roll in individual tracks which are designated track-panel pairs. As the panels move into the head area, they run through curved tracks and are nested there. Once an upper section is positioned into its storage location, the next panel is pushed into a track below the rested panel is in turn stored. This repeats until all panels are stored. The stored panels stacked horizontally one atop another with the door in an open configuration. The need for securing tracks to the ceiling as in standard sectional door installations is avoided.

This invention in some aspects utilizes a dedicated panel-track pairing as well as a unique hook/cam device which allows for the upper panel to be both locked in the closed position and pushed away for separation and storage in the open position.

The sectional door allows for low headroom clearance, high speed closing/opening and a multitude of panel heights. Advantages of this design in various embodiments include improved ability to increase glazing size for improved lighting, high speed improved traffic flow and a reduction in heating/cooling losses, improved aesthetics through larger panel for design elements and cantilever effect for possible shading when open for commercial and retail installations.

The invention in various aspects includes a hingeless door system capable of operating fast (5 ft/sec) and within a low headspace with a self-contained head section. This allows for a rapid panel replacement if one is impacted, the elimination of the hinges which are wear items with standard garage doors and the possibility to have such a solution with large panel sections offers greater aesthetic design range.

A high speed door according to embodiments of this invention offers increased vision capability and better design aesthetics. The panel sections oriented in a single plane when the door is closed to appear consistent with standard sectional doors. A hingeless door offers improved design aesthetics by allowing consistent interior and exterior facades. This is accomplished in part by developing a platform that employs multiple tracks which guide individual panels. The guides may be angled and the guide roller position is offset to allow for engagement to the track while maintaining a vertical orientation of the panel when closed.

The supporting framework of embodiments of this invention is not connected to any ceiling structures, but rather has a double side seal column with structure to support the vertical load of the door. The double side seal construction blocks air and water entry through the sides of the door. One seal seals the door frame with the wall and a second seal mates with the outside of the extruded section end stiles.

The hingeless design offers the advantage that there are fewer moving parts in the system allowing for longer lifecycles as well as reliable operation.

This invention allows for high speed, high cycle doors to use standard and even larger than standard panel sections. This is an advantage because, as mentioned before, larger panels allow for the improved look of the door which is desired as well as reducing the number of panel connections improving the thermal barrier giving superior insulation over extruded sections.

Then nesting of the sections in the open, stored position, also gives maintenance easy access to swap out panels without significant disruption to the remaining components.

The high-speed sectional door, as well as components, methods and sub-systems of the door, are each considered to be aspects of this invention.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
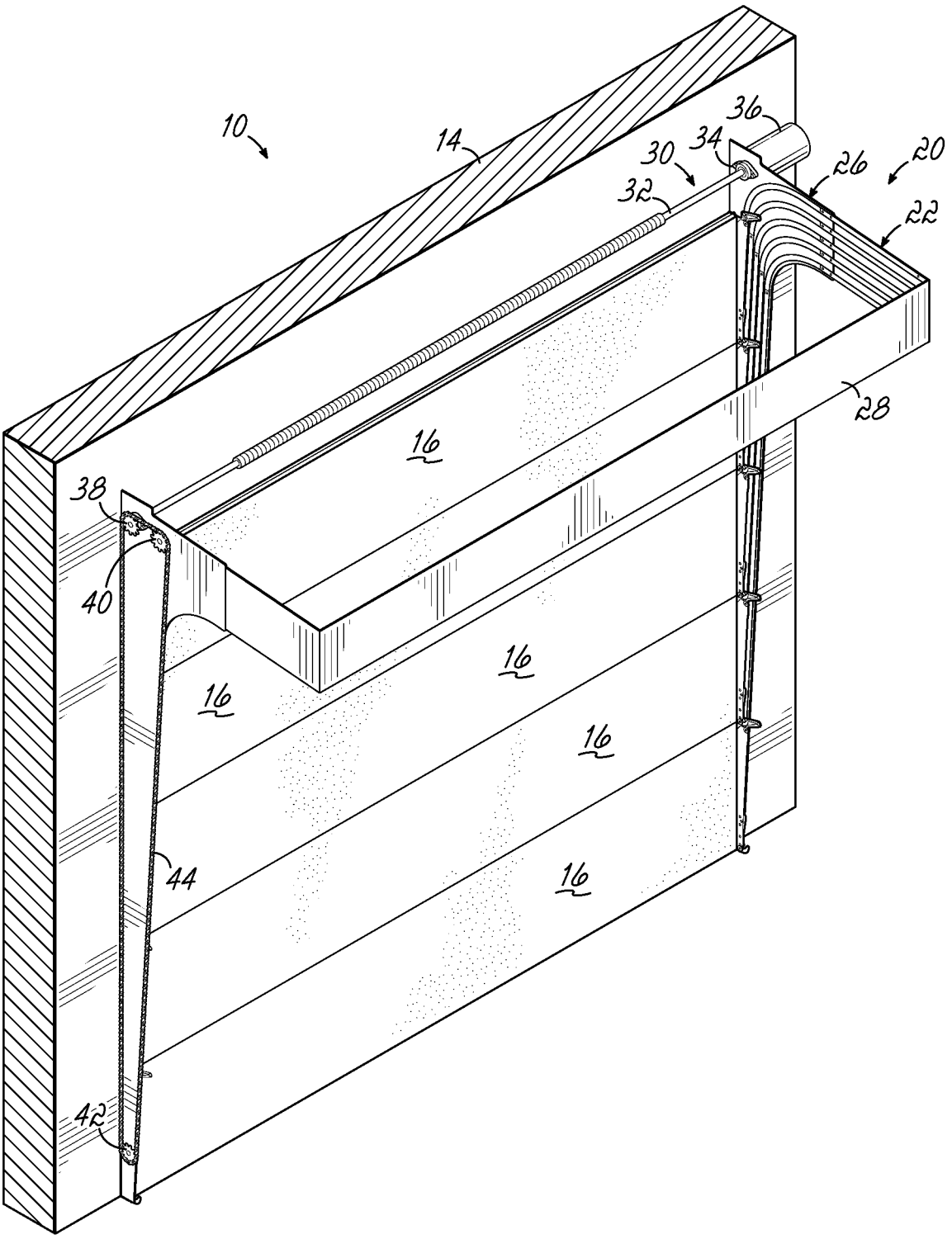
FIG. 1 is a perspective view of one embodiment of a door installation according to this invention.
Figure 2:
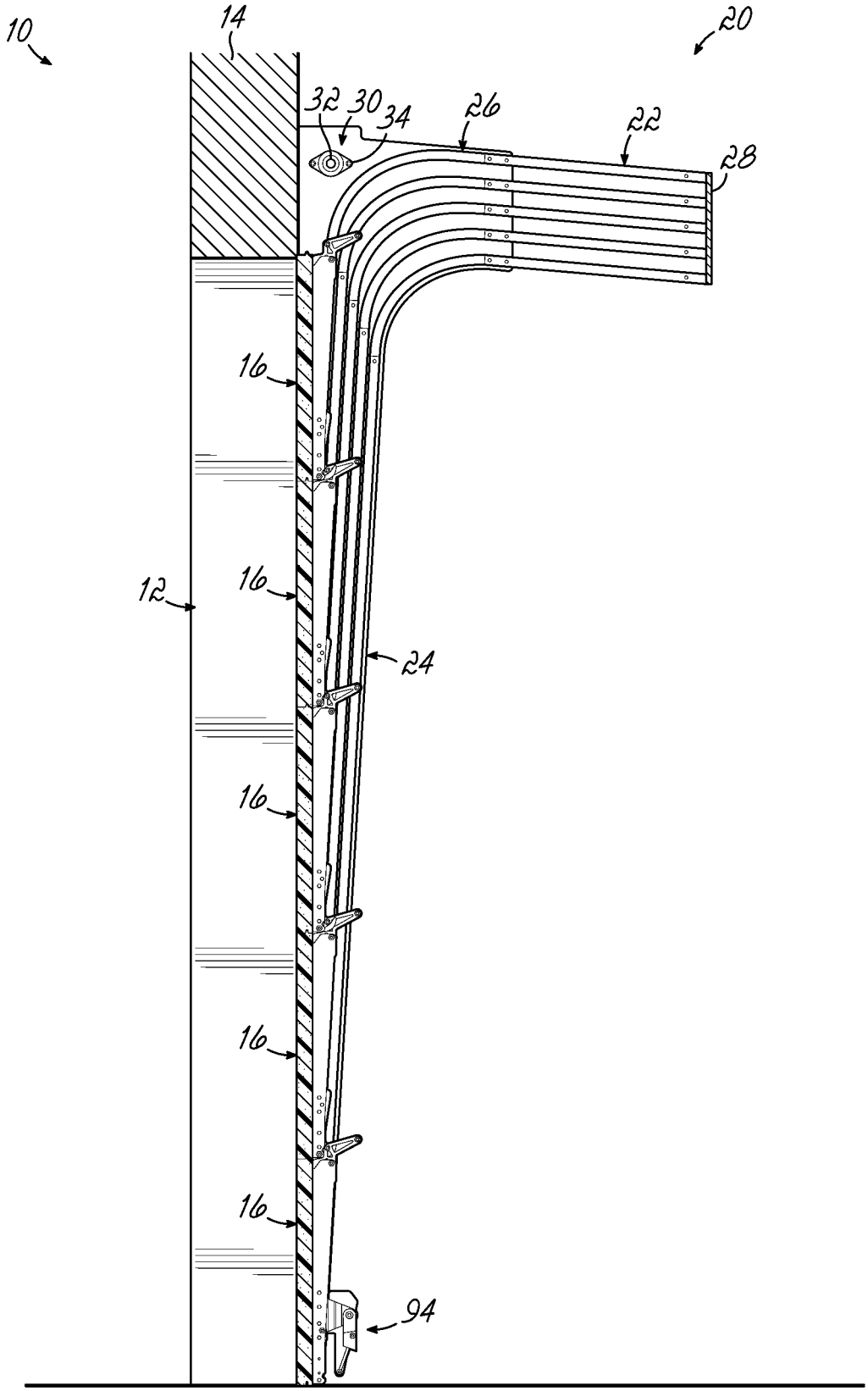
FIG. 2 is a side elevational view of the door installation of FIG. 1 in partial cross-section.
Figure 3:
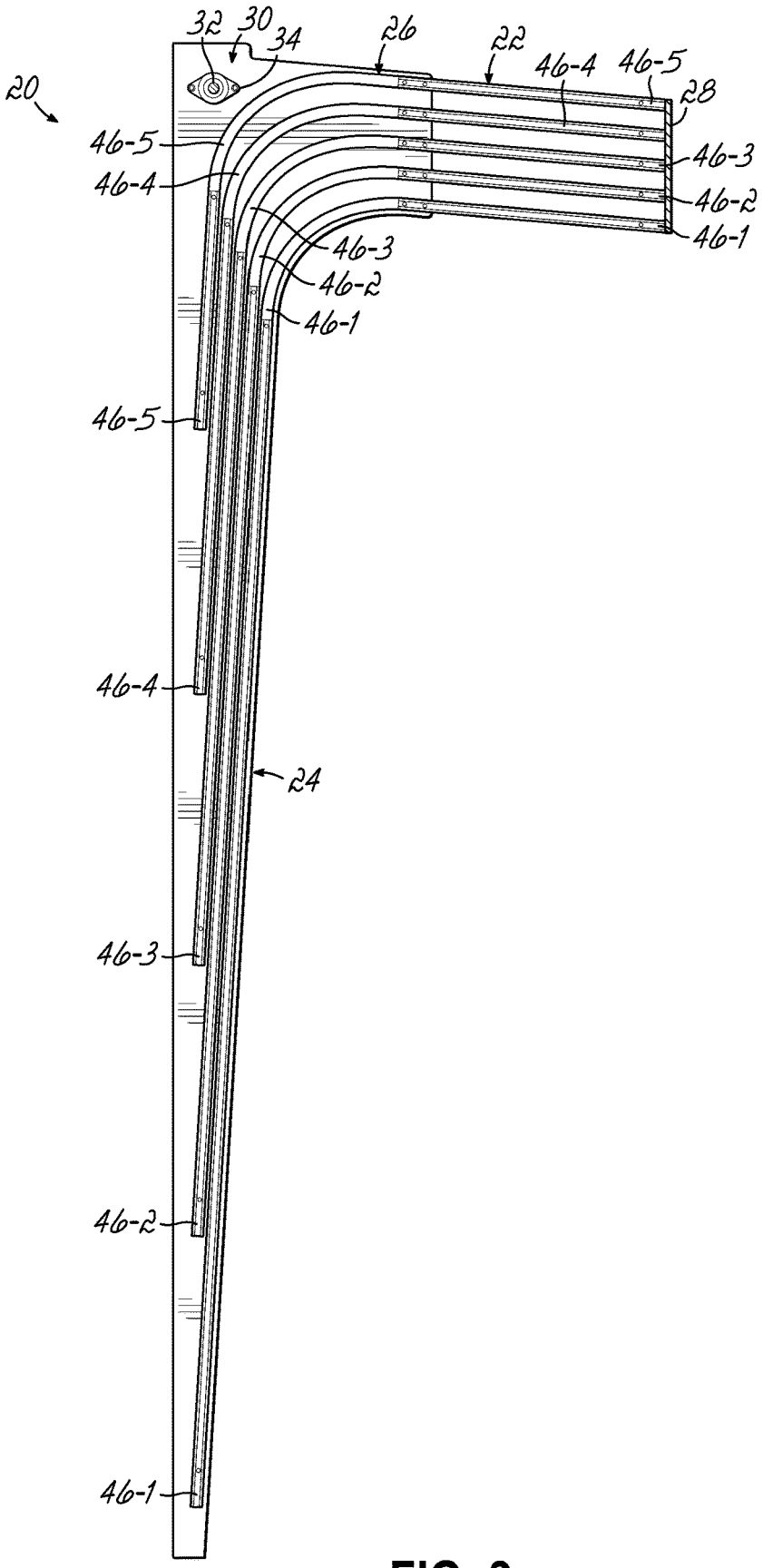
FIG. 3 is a view similar to FIG. 2 with some of the environment removed for easier viewing of the door components.

Referring to FIGS. 1-3, one embodiment of a high-speed sectional door 10 according to this invention is shown. The sectional door 10 may be utilized in a residential, commercial, institutional or other structure to selectively cover an opening in a wall of the structure. The high-speed sectional door 10 includes a number of elongate and generally horizontally oriented door panels 16 of which five are shown in the embodiment presented in FIGS. 1-3. The door 10 and associated door panels 16 are movable selectively to and between a closed position as shown in FIG. 1 in which the door 10 covers the opening 12 in the wall 14 and an open position which exposes the wall opening 12 in the wall 14 and positions the door panels 16 in a head area superjacent the opening 12 as shown generally in FIG. 19.

The door panels 16 are each mounted within a track system 20 having generally horizontal sections 22, vertical sections 24 and transition sections 26 mounted on each side of the wall opening 12 at the longitudinal ends of the door panels 16 as shown in FIGS. 1-3. The horizontal track sections 22 at the opposite ends of the door panels 16 are joined together by a head section 28 of the track system as shown in FIG. 1.

According to one aspect of this invention, each door panel 16 can be made from combining individual subpanels with 18 inch or 21 inch heights. The combinations of 18 inch subpanels and 21 inch subpanels can be used to allow for door height increments of 3 inches. Subpanels joined using a solid stile or by hinging two subpanels together. Mechanical fasteners are not used to join the sub-panels due to the risk of wear or loosening under the higher speed operating conditions present with a high speed door. The overlap of the extruded aluminum stile cross section profile is designed to allow for an adhesive bond. Therefore, the subpanels can be combined by adhesive bonding through the stile rather than mechanical fastening.

A counterbalancing system 30 may also be used with the high-speed sectional door 10 according to various embodiments of this invention and includes a counterbalancing rod 32 extending between and mounted to the horizontal track sections 22 at the opposite sides of the door system 10 as shown in FIG. 1. The counterbalancing rod 32 is mounted for rotation in bearings 34 on each of the horizontal track sections 22 of the door 10. A counterbalance operator 36 in the form of a motor or other system is mounted on one end of the counterbalance system 30 and coupled to the rod 32. On the opposite end of the counterbalance system 30 are three sprockets 38, 40, 42 with a chain 44 trained around them. One sprocket 38 at the upper end of the vertical section 24 of the track system 20 is mounted for rotation with the counterbalance rod 32. Sprocket 40 is mounted for rotation and spaced from the driven sprocket 38 at the upper end of the track system 20. At the lower end of the track system 20 and mounted on the vertical track section is the third sprocket 42 and the chain 44 is trained around the sprockets 38, 40, 42 and coupled to the lowermost door panel 16 as will be described later herein. Raising and lowering of the door 10 is facilitated by the counterbalance system 30.

As shown generally in FIGS. 2-3, the sections 22, 24 and 26 of the track system 20 at each lateral side of the door 10 includes an individual track for each of the door panels 16 in the door 10. One of ordinary skill in the art will appreciate that the track sections 22, 24 and 26 are actually track section pairs as each section has a portion on each side of the door opening. The embodiment of the door shown in FIGS. 1-3 includes five door panels 16 and five individual pairs 46-1, 46-2, 46-3, 46-4 and 46-5 are provided in the horizontal, vertical and transition sections of the track system 20. The vertical sections 24 of the track system 20 extend different lengths depending on the position of the associated door panel 16. For example, the vertical section 24 of the individual track 46-2 for the lowermost door panel is longer than the other individual tracks 46-2, 46-3, 46-4 and 46-5 as shown generally in FIGS. 2 and 3. While the vertical sections are referred to herein as "vertical" and "horizontal", respectively, it will be appreciated that they are not strictly vertical or horizontal, but may be staggered and angled as shown generally in FIG. 3 to accommodate the geometry and spatial relationships of the door panels 16.

Figure 4:
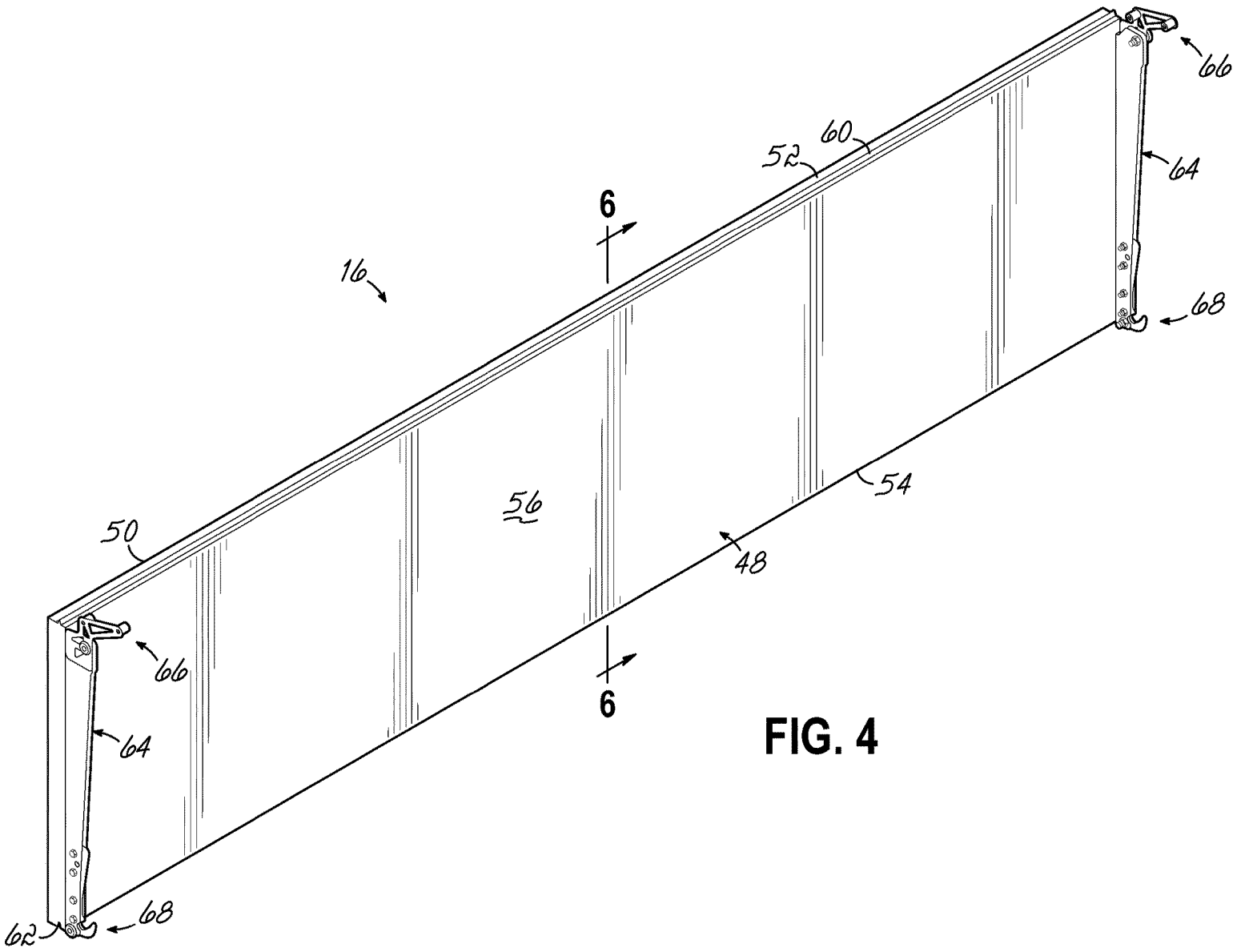
FIG. 4 is a perspective view of one of the panels of the door of FIG. 1.

Referring to FIG. 4, one embodiment of the door panel 16 according to this invention is shown. The door panel 16 includes a panel body 48 which includes an outer face 50, an upper edge 52, a lower edge 54 and may include an inner face 56 as shown in FIG. 4. In various embodiments, at least a portion, if not all, of the front face 50 of each door panel 16 is coplanar with at least a portion, if not all, of the front face 50 of each of the other door panels 16 when the door 10 is in the closed position (see FIG. 2). The panel body 48 may be constructed of metal such as aluminum, vinyl or other material and include internal insulation 58 as shown generally in the cross-section of the door panel 16 in FIG. 6. The upper edge 52 of the door panel 16 may include a tongue 60 which is compatible with a groove 62 on the lower edge 54 of the adjacent door panel 16. The tongue 60 and groove 62 on the door panel 16 are designed to mate together with the groove 62 and tongue 60 of the adjacent door panel 16 in the door system 10 as shown generally in FIG. 2. It will be appreciated that other shapes, designs and embodiments of the door panel 16 may be utilized with this invention and the door panel 16 shown and described herein is but one example of a door panel according to this invention.

Figure 5:
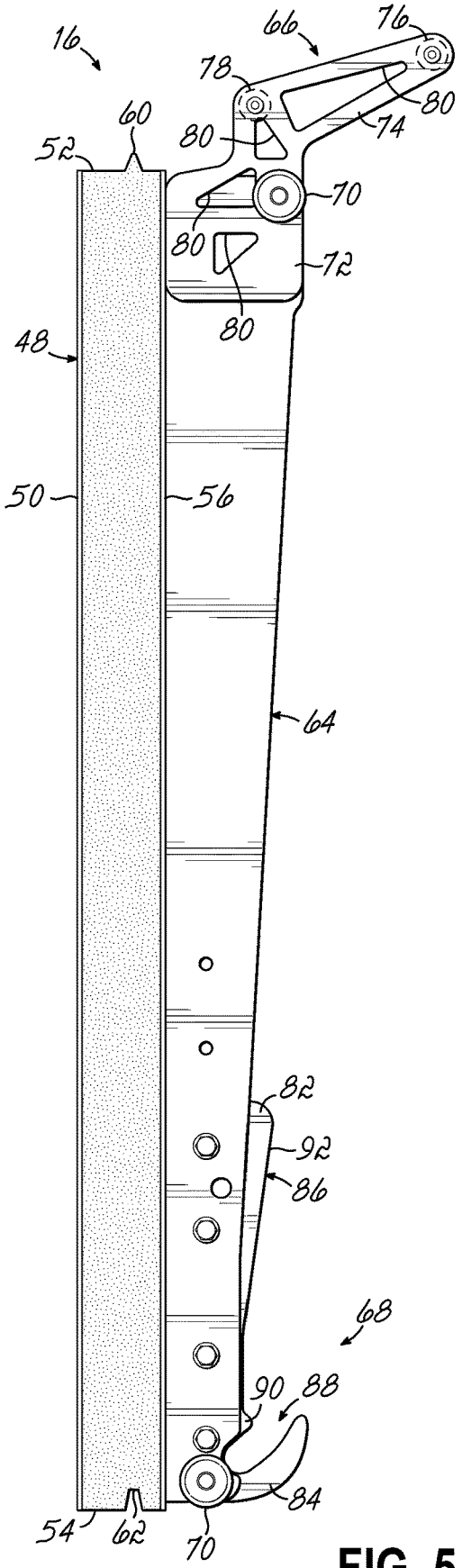
FIG. 5 is a side elevational view of the door panel of FIG. 4.
Figure 6:
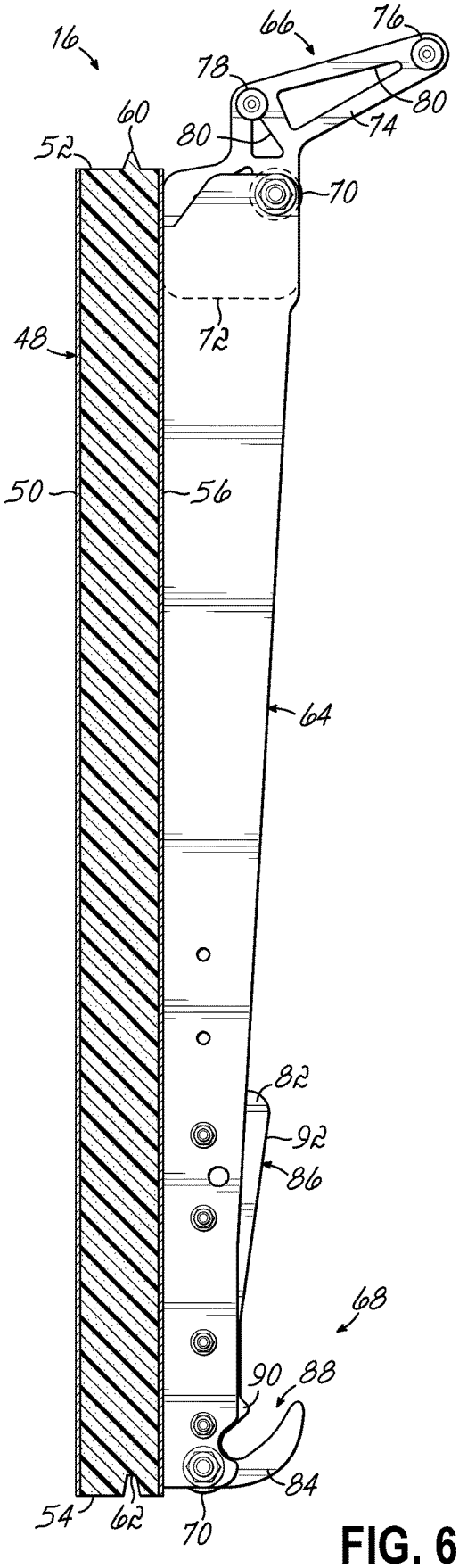
FIG. 6 is a cross-sectional view of the door panel taken along line 6-6 of FIG. 4.

Each door panel 16 may also include a pair of side panel brackets 64 mounted on the lateral ends of the door panel 16 as shown generally in FIGS. 5-6. The panel brackets 64 extend rearwardly from the panel body 48. The panel brackets 64 extend generally and substantially the entire height of the door panel 16 and may have a tapered configuration such as that shown in FIGS. 5-6.

A cam assembly 66 is mounted to the upper end of each panel bracket 64 and a hook assembly 68 is mounted to the door panel 16 at a lower end of each bracket 64. Track rollers 70 are mounted to the panel bracket 64 and directed outwardly from the door panel 16 at the hook assembly 68 and cam assembly 66 thereby providing two track rollers 70 for each side edge of each door panel 16. The track rollers 70 are captured within the individual tracks associated with the door panel 16 to guide the movement of the door panel 16 during the opening and closing of the door 10.

One embodiment of the cam assembly 66 as shown particularly in FIGS. 4-6 includes a generally rectangular or square cam body 72 mounted to the upper end of the panel bracket 64. A cam arm 74 extends upwardly and rearwardly from the door panel 16 and the cam body 62. A first or distal cam roller 76 and a second or proximal cam roller 78 are each mounted as shown in FIGS. 5-6 on the cam arm 74 of the cam assembly 66. The cam rollers 76, 78 face inwardly in an opposite direction from the track roller 70 of the cam assembly 66. The cam body 72 and cam arm 74 may include apertures 80 to minimize the weight and provide appropriate strength to the cam assembly 66. In the cam assembly 66 shown in FIG. 5, four such apertures 80 are provided, each of which is generally triangular in shape, but other designs, geometries and configurations of the cam assembly 66 are well within the scope of this invention.

As shown in FIGS. 4-6, the hook assembly 68 which is mounted to the panel bracket 64 proximate the lower side edge of all but the lowermost door panel 16 includes a hook body 82 which may be bolted, screwed or otherwise secured to the panel bracket 64 for mounting. The hook assembly 68 also includes a hook arm 84 which extends arcuately from the track roller 70 on the hook assembly 68. An inner edge of the hook arm 84 defines in part a cam surface 86 on which the proximal roller 78 of the cam assembly 66 of an adjacent door panel 16 rolls. The cam surface 86 includes the inner edge of the hook arm 84 as well as a pocket 88 which leads to a bump 90 and a gradually sloped portion 92 of the cam surface 86 on the hook assembly 68. The interaction of the proximal roller 78 of the adjacent door panel 16 with the cam surface 86 of the hook assembly 68 will be described in more detail hereinbelow.

Figure 7:
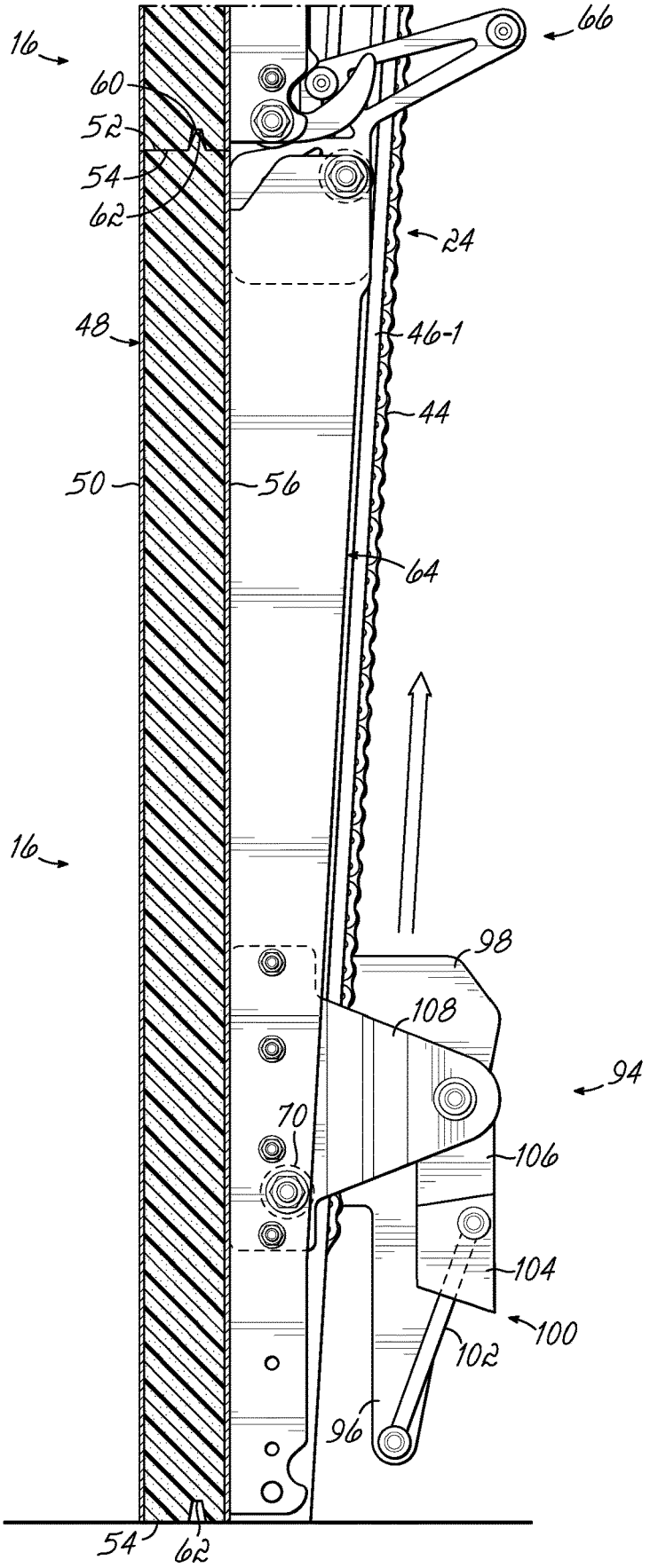
FIG. 7 is a view similar to FIG. 6 with the door panel coupled to an adjacent similar door panel.

As shown particularly in FIG. 7, a carriage assembly 94 is mounted to the panel bracket 64 proximate the lower edge of the lowermost panel 16 of the door 10 instead of the hook assembly 68 as is utilized proximate the lower edge of each of the other door panels 16 in the door 10. The chain 44 which is part of the counterbalance system 30 is secured to the arm 96 projecting downwardly from a carriage bracket 98 of the carriage assembly 94 to initiate upward movement of the door 10 in the opening sequence and downward movement of the door 10 in the closing sequence.

In one embodiment, the carriage assembly 94 includes the generally triangular-shaped carriage bracket 98 mounted to the panel bracket 64 by bolts, screws or other means. A track roller 70 extends outwardly from the carriage bracket 98 as shown in FIG. 7. The track roller 70 on the carriage assembly 94 is seated within the individual track 46-1 associated with the lowermost panel 16 of the door 10.

The carriage assembly according to one embodiment as shown in FIGS. 7 and 17-19 also includes a carriage link 100 pivotally mounted to the distal end of the carriage arm 96 on the carriage bracket 98. The carriage link 100 may include a post 102 fixed to a triangular mount 104. The triangular mount 104 is fixed to a lug 106 at one end of the mount 104. An opposite end of the lug 106 is pivotally coupled proximate to the peak of a triangular sloped carrier 108. The base of the carrier 108 is bolted to the panel bracket 64 on the lowermost panel 16.

In closing and opening the door 10, the chain 44 moves upwardly and downwardly as appropriate for the closing or opening operation. The carriage bracket 98 moves with the chain 44. The carriage assembly 94 which is coupled to the chain 44 moves the lowermost door panel 16 in the same direction as the movement of the chain. Articulation of the various components of the carriage assembly 94 allows for movement of the carrier 108 up and down with the chain 44 while the remaining components of the carriage assembly 94 articulate and pivot relative to one another to allow for movement of the lowermost panel 16 of the door 10 from the vertical track section 24 to the transition track section 26 and the horizontal track section 22 as appropriate.

Figure 8:
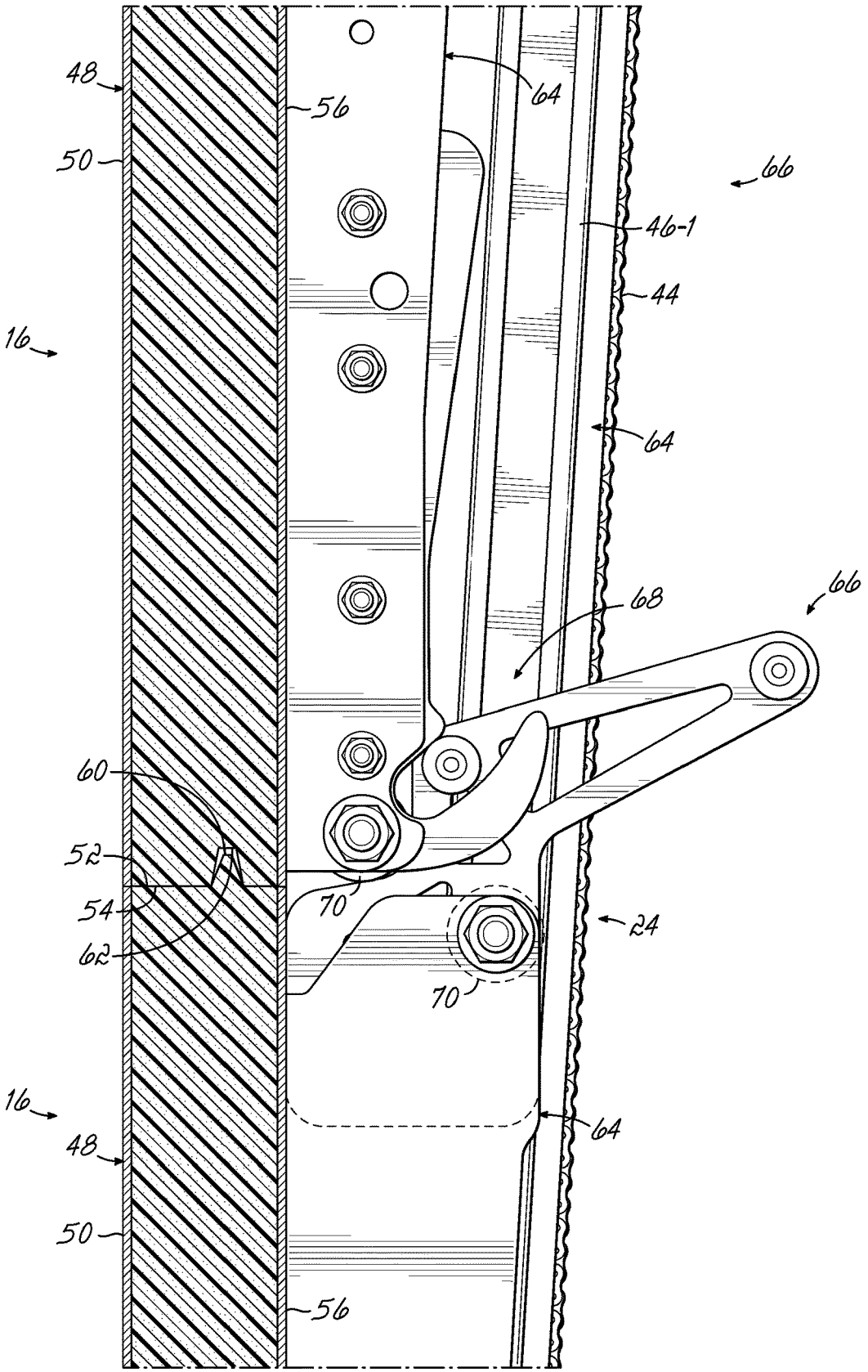
FIG. 8 is a view similar to FIG. 7 enlarged to show the coupling of the adjacent door panels.
Figure 8A:
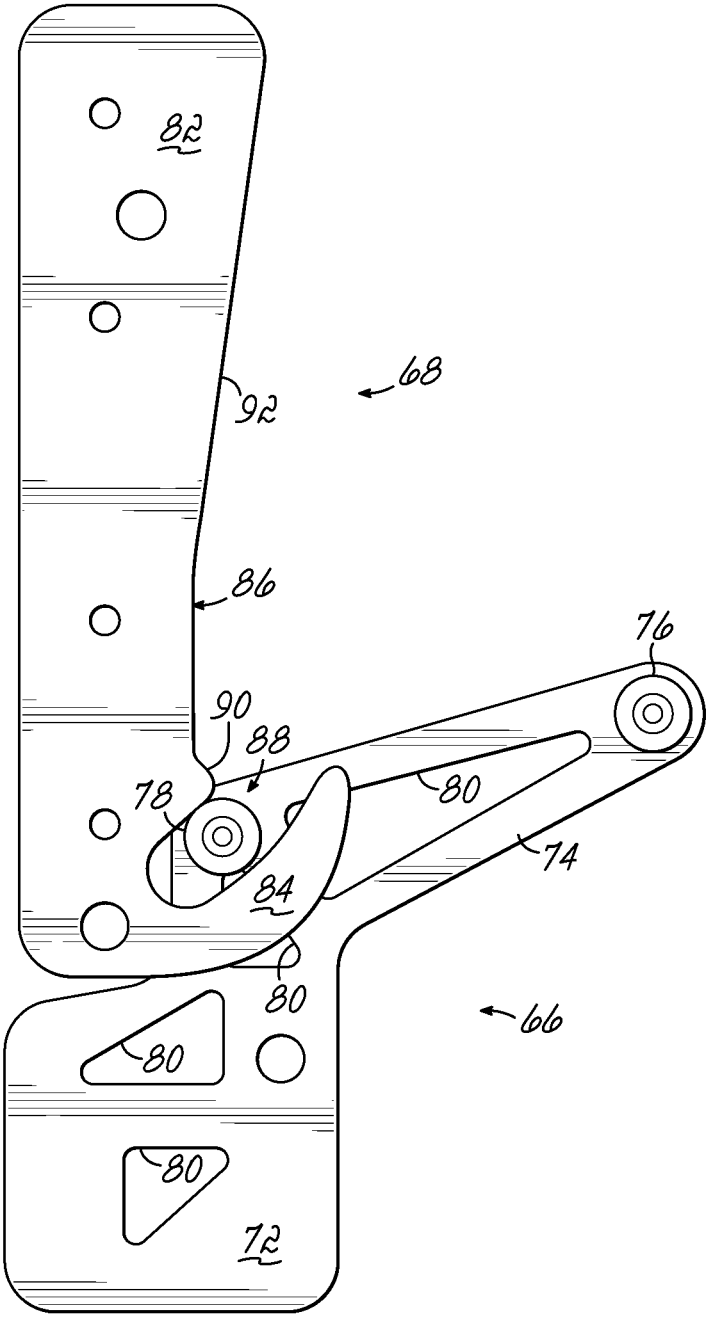
FIG. 8A is a side elevational view of a hook and a cam of one embodiment of this invention engaged to couple adjacent door panels together.

In FIGS. 7-16, the sequential movement of the two uppermost door panels 16 on the door 10 during the door opening operation are shown. In FIGS. 8A, 9A, 10A, 11A, 12A, 13A, 14A, 15A and 16A, the hook assembly 68 of the uppermost door panel 16 is shown in relation to the cam assembly 66 of the subjacent door panel and their relative position to one another throughout the opening operation of these drawings. Initially, as shown in FIGS. 8-8A with the door 10 in the closed position, the door panels 16 are mated in an edge-to-edge relationship with the groove 62 of the uppermost door panel 16 receiving the tongue 60 of the immediately subjacent door panel 16. Additionally, the proximal cam 68 of the subjacent door panel 16 on the cam assembly 66 is seated within the pocket 88 of the hook assembly 68 on the uppermost door panel 16 and on a leading edge on the bump 90 on the cam surface 86 thereof.

Figure 9:
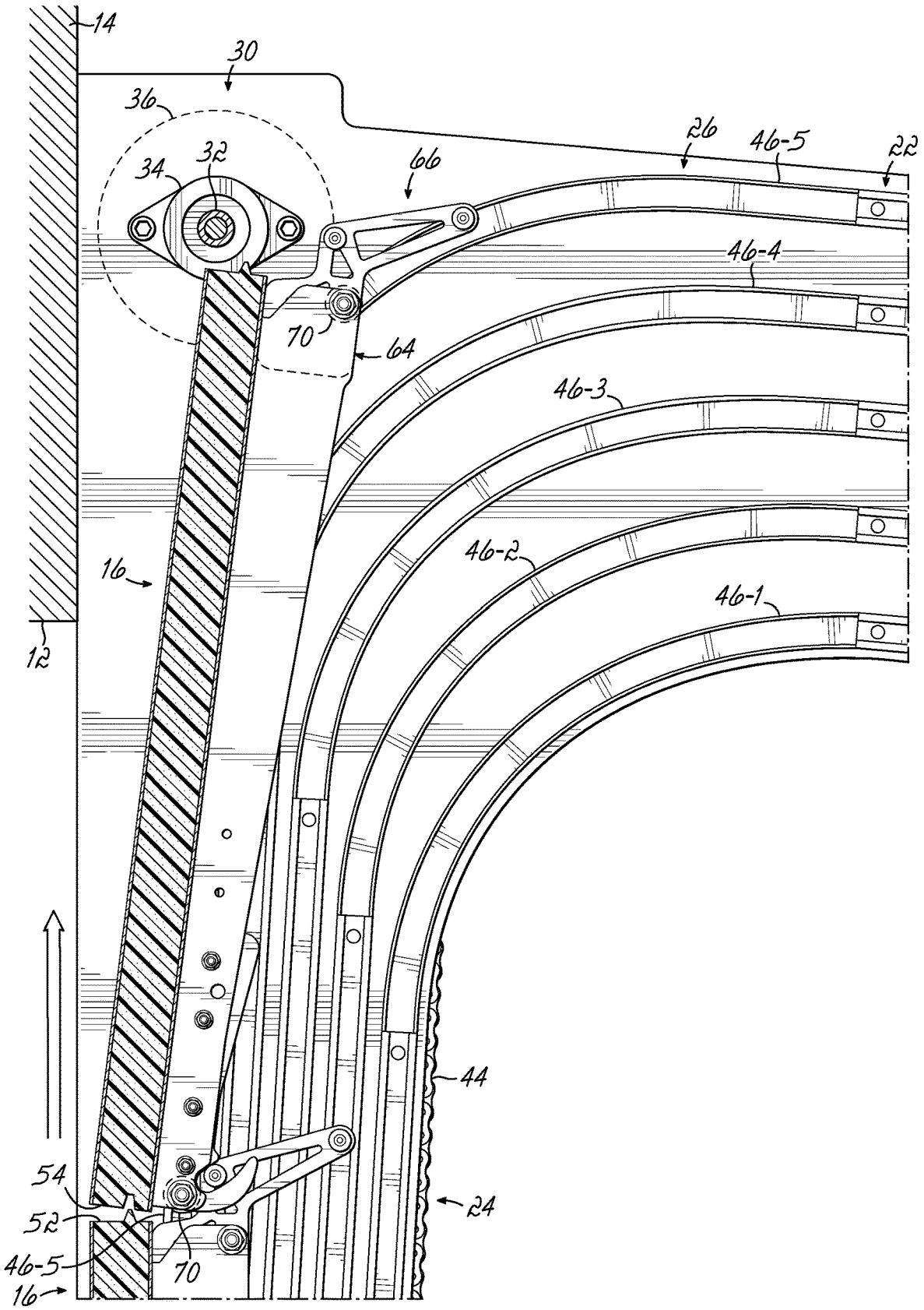
FIG. 9 is a side elevational view showing an uppermost door panel in cross-section of the door installation of FIG. 1 advancing upward from a vertical track section toward a horizontal track section.
Figure 9A:
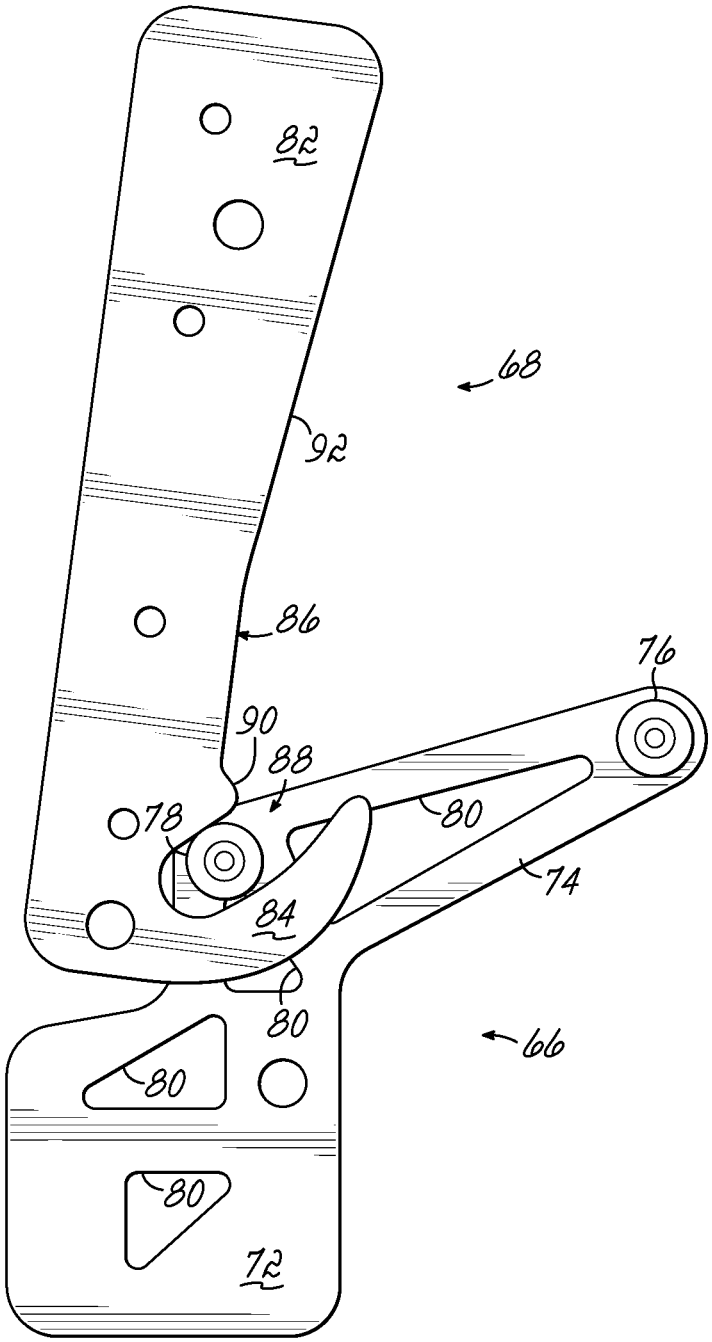
FIG. 9A is a view similar to FIG. 8A of the hook and cam components of the adjacent door panels of FIG. 9.

As shown in FIG. 9, the track roller 70 on the cam assembly 66 of the uppermost door panel 16 is seated within the track 46-5 associated with the uppermost door panel 16; namely, the uppermost track 46-5 in the horizontal track section 22 and the forwardmost track 46-5 adjacent to the wall 14 in the vertical track section 24. Upward movement of the door 10 from the closed configuration toward the open configuration advances the track roller 70 of the uppermost door panel 16 on the cam assembly 66 into and through the transition track section 26 of the track 46-5 associated with the uppermost door panel 16. This movement begins separation of the lower edge 54 of the uppermost door panel 16 from the upper edge 52 of the subjacent door panel 16 as shown in FIG. 9. The track roller 70 of the hook assembly 68 of the uppermost door panel 16 travels within the upper portion of the vertical track section 24 of the track 46-5 associated with that door panel 16.

Figure 10:
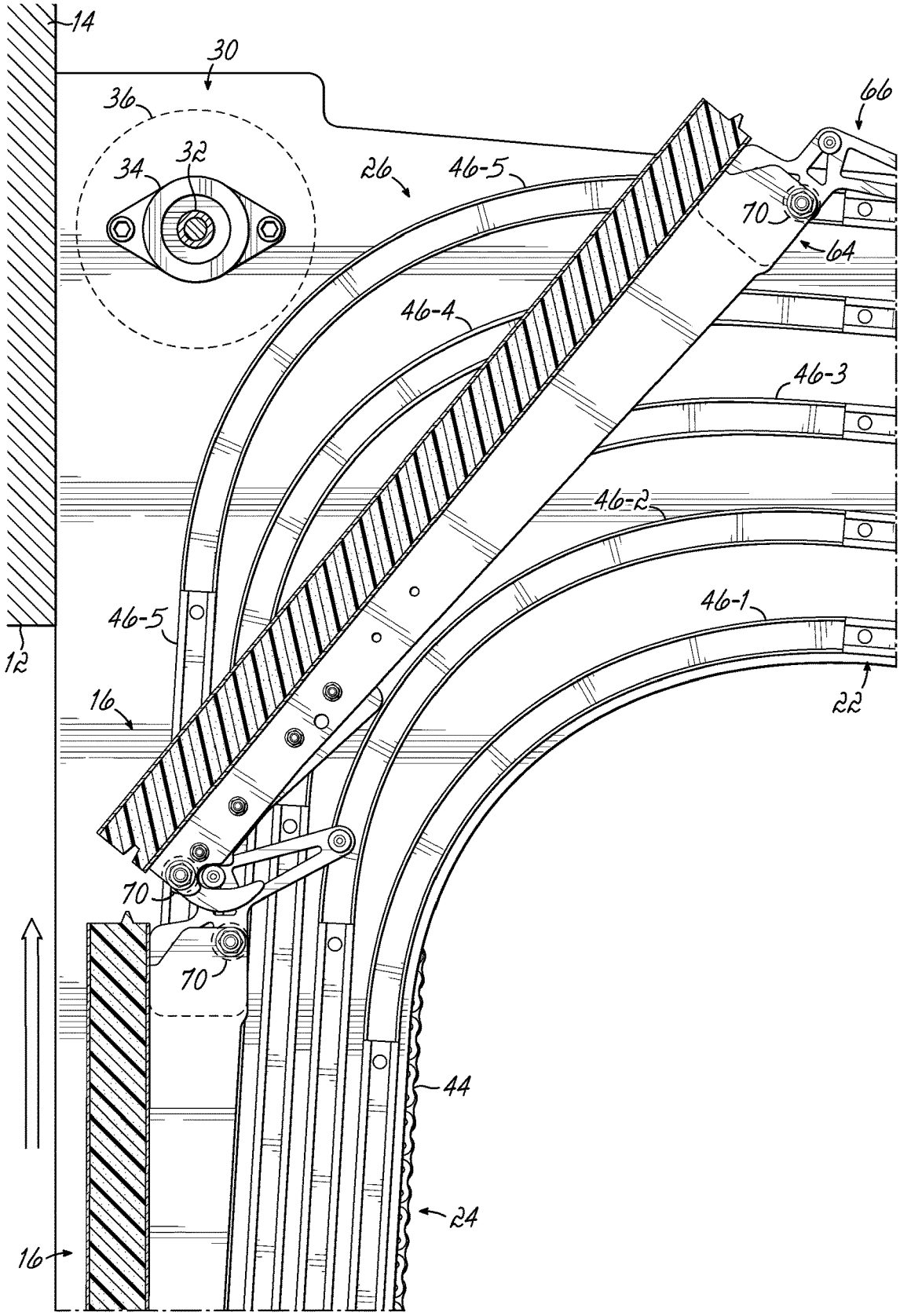
FIG. 10 is a view similar to FIG. 9 with the uppermost door panel in a transition track section between the vertical and horizontal track sections.
Figure 10A:
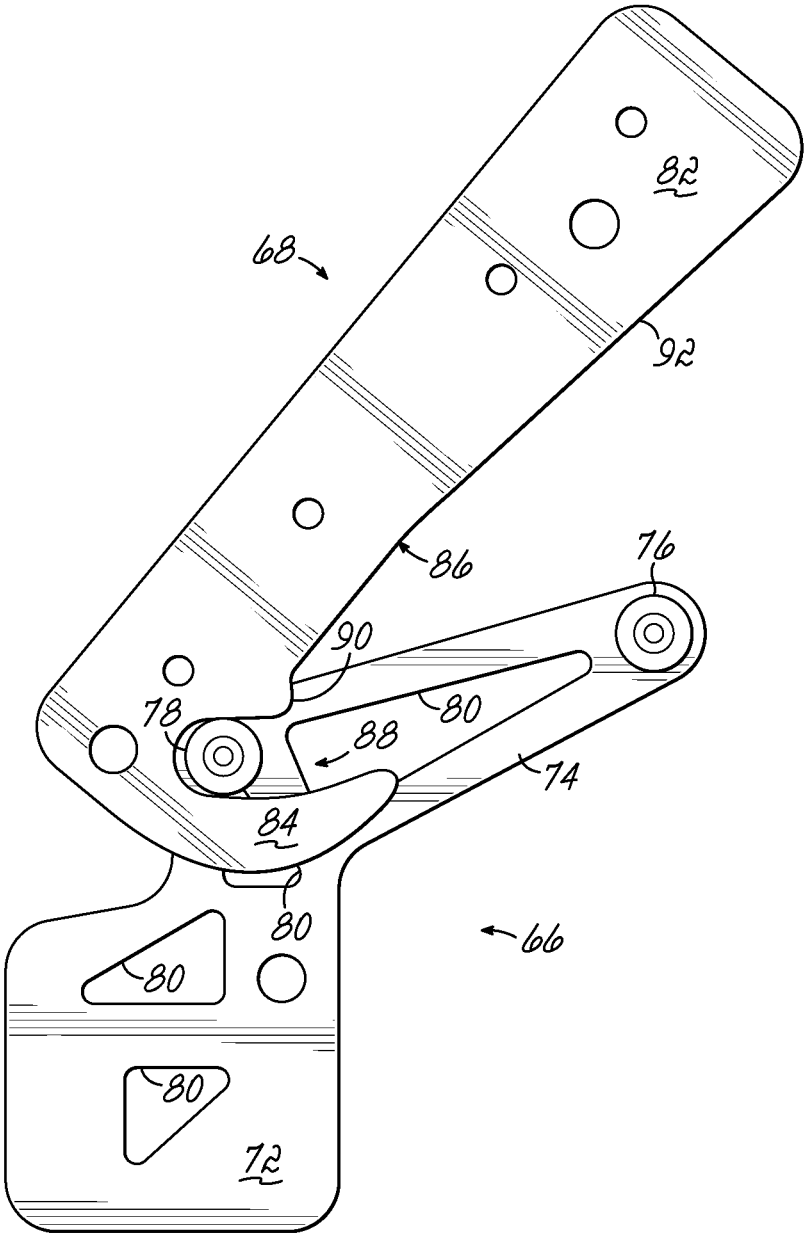
FIG. 10A is a view similar to FIG. 8A of the hook and cam components of the adjacent door panels of FIG. 10.

With the door 10 proceeding upwardly as in FIG. 9, the track roller 70 on the cam assembly 66 of the uppermost door panel 16 enters the horizontal track section 22 of the track 46-5 associated with that door panel 16 and the separation between the uppermost door panel and the subjacent door panel widens and the uppermost door panel 16 begins to pivot away from the generally horizontal configuration when the door 10 was in the closed position. As shown in FIG. 10A, the cam roller on the proximal cam roller 78 on the cam assembly 66 of the subjacent door panel 16 initially retracts within the pocket 88 of the hook assembly 68 on the uppermost door panel 16 and away from the bump 90 on the cam surface 86.

Figure 11:
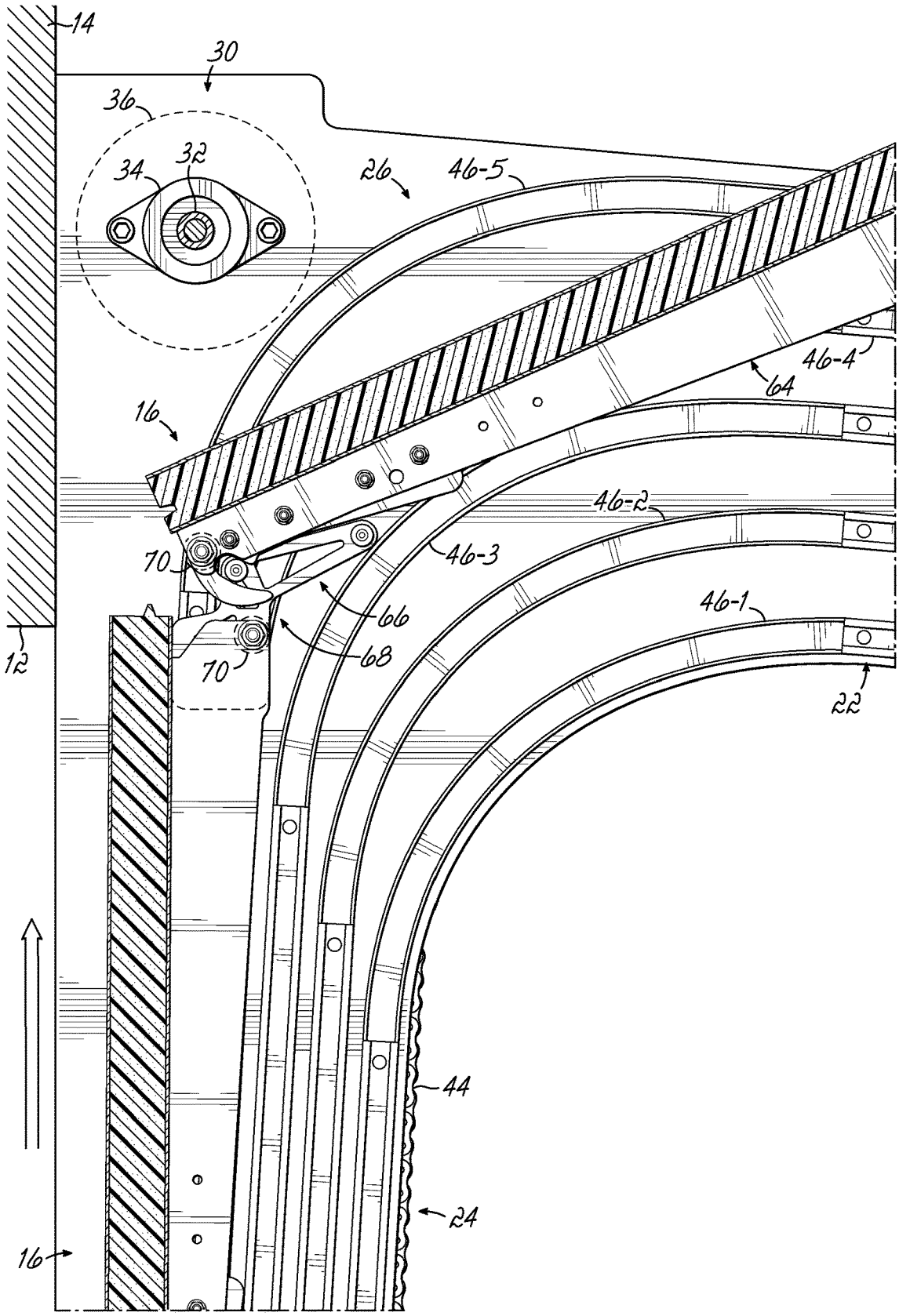
FIG. 11 is a view similar to FIG. 10 with the uppermost door panel exiting the transition track section and seating in the horizontal track section.
Figure 11A:
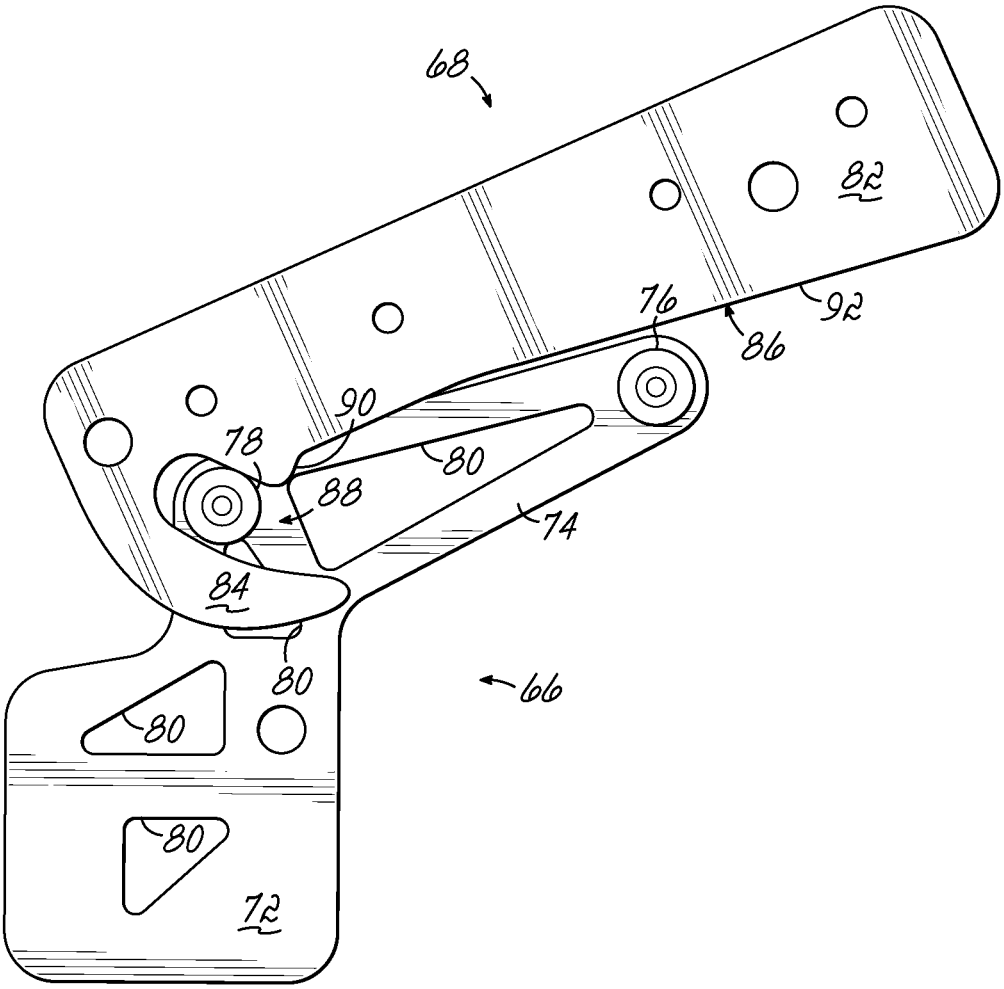
FIG. 11A is a view similar to FIG. 8A of the hook and cam components of the adjacent door panels of FIG. 11.

Continued upward movement of the door 10 is shown in FIGS. 11 and 11A with the proximal cam roller 78 advancing toward the bump 90 on the cam surface 86 of the hook assembly 68 on the uppermost door panel 16. The distal cam roller 76 likewise is positioned closer to the cam surface 86 of the hook assembly 68 on the uppermost door panel 16 due to the relative positions of the door panels as shown in FIG. 11.

Figure 12:
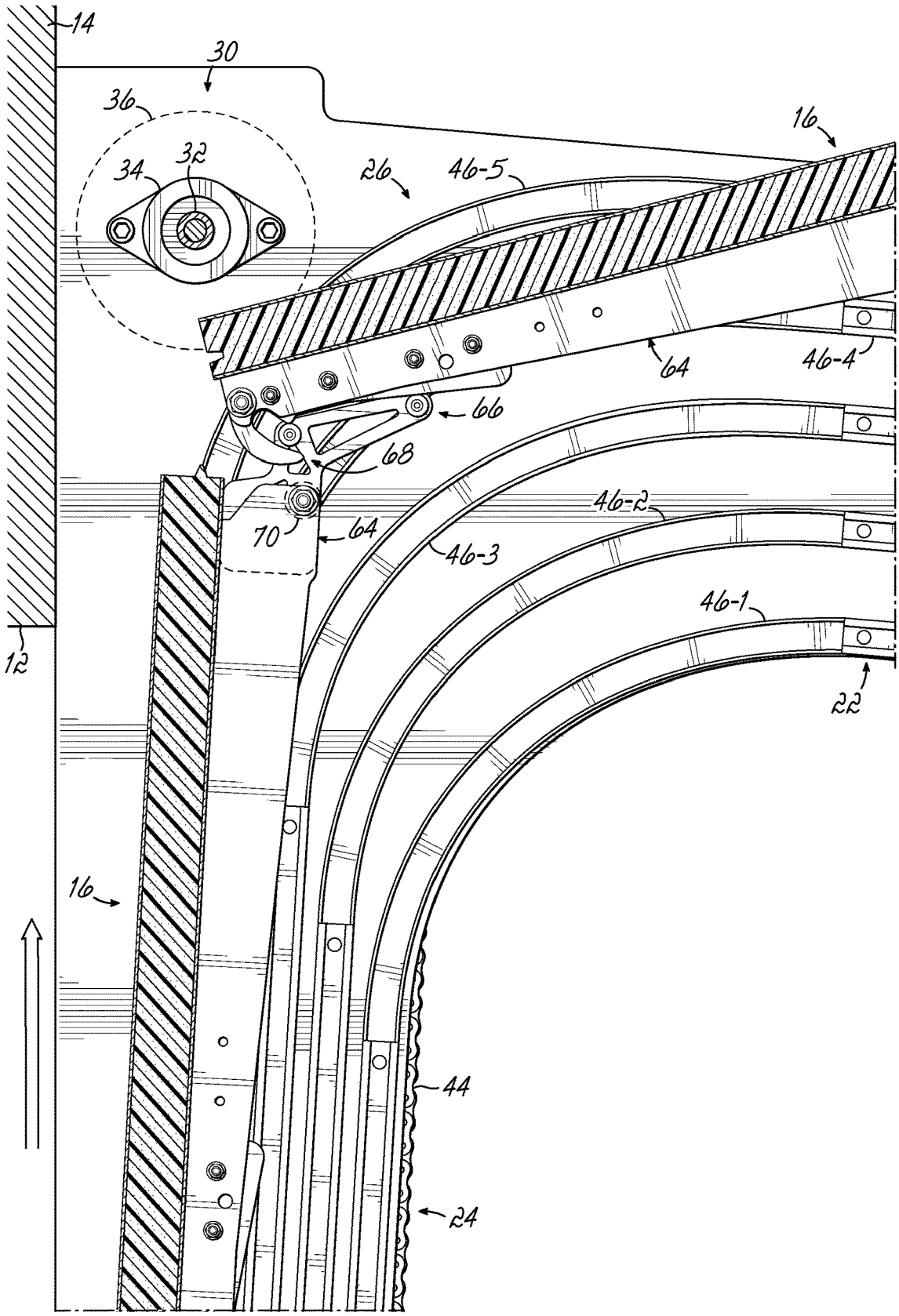
FIG. 12 is a view similar to FIG. 11 with the door panel adjacent to the uppermost door panel entering the transition track section.
Figure 12A:
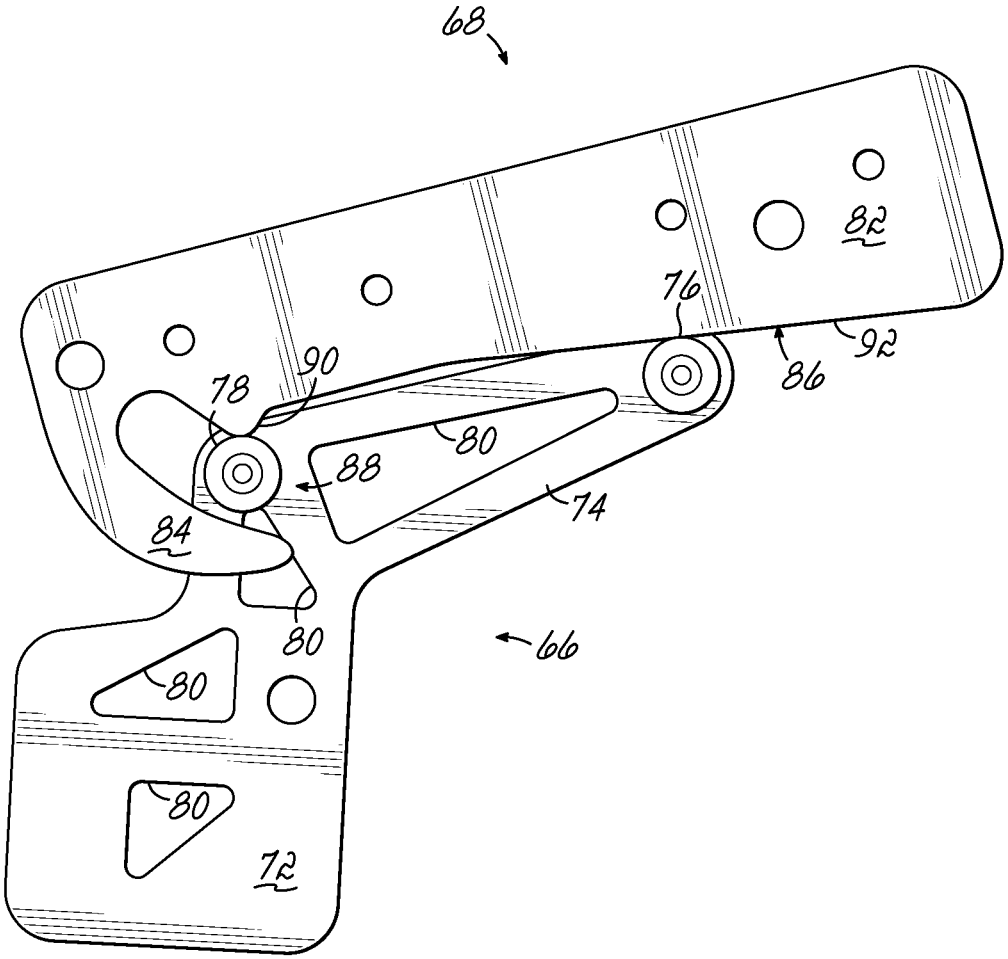
FIG. 12A is a view similar to FIG. 8A of the hook and cam components of the adjacent door panels of FIG. 12 disengaging from each other.

Continued upward movement of the door 10 toward the open configuration as shown in FIGS. 12 and 12A results in the proximal cam roller 78 on the cam assembly 66 of the subjacent door panel 16 engaging the cam surface 86 of the hook assembly 68 on the uppermost door panel 16 (FIG. 12A). Additionally, the proximal cam roller 78 approaches the apex of the bump 90 on the cam surface 86. The track roller 70 of the uppermost door panel 16 on the hook assembly 68 is transitioning into and through the transition section 26 of the track 46-5 associated with the uppermost door panel 16 as shown in FIG. 12.

Figure 13:
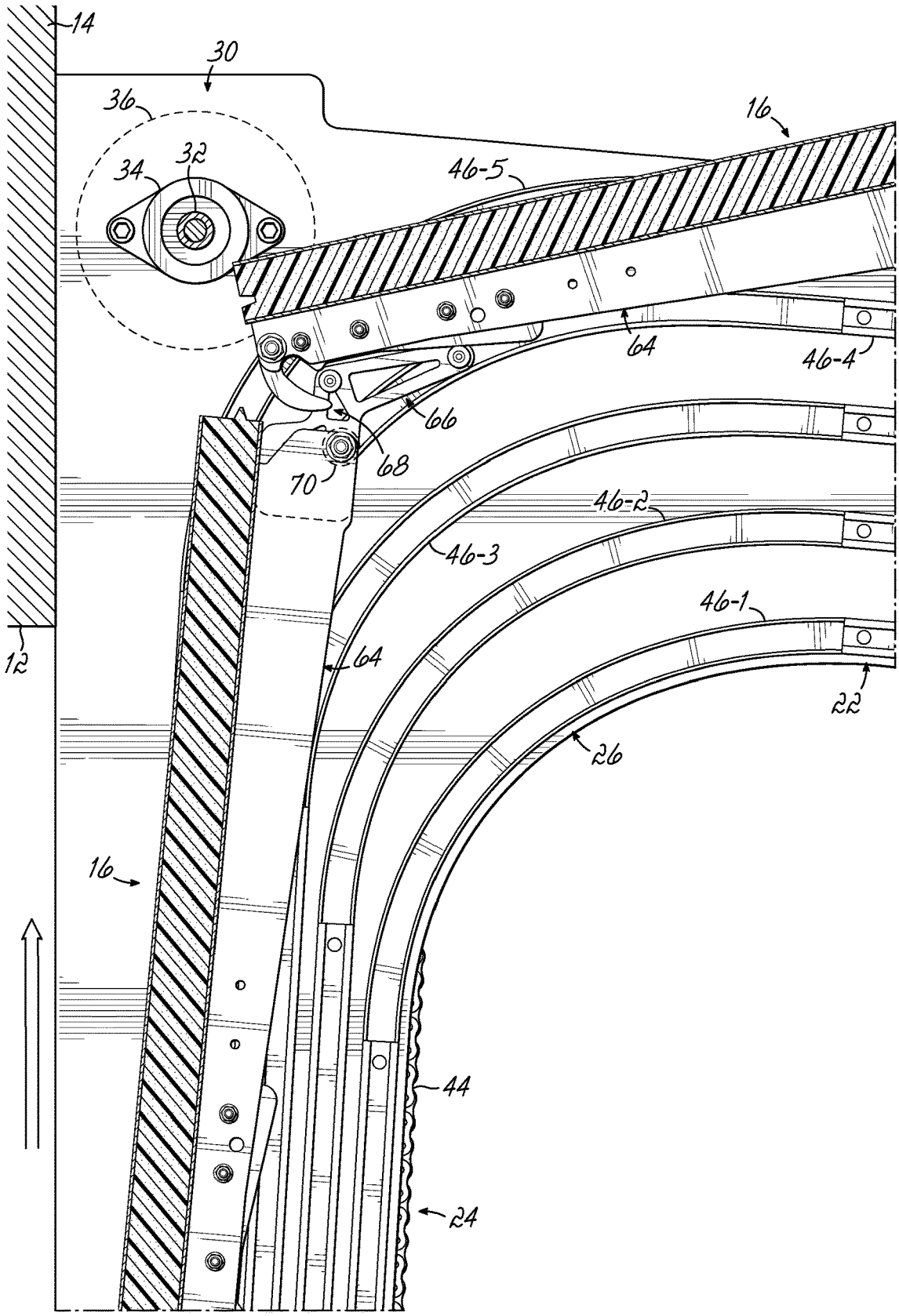
FIG. 13 is a view similar to FIG. 12 with the uppermost door panel disengaging from the adjacent door panel while seating in its associated horizontal track section and the adjacent door panel entering its associated transition track section.
Figure 13A:
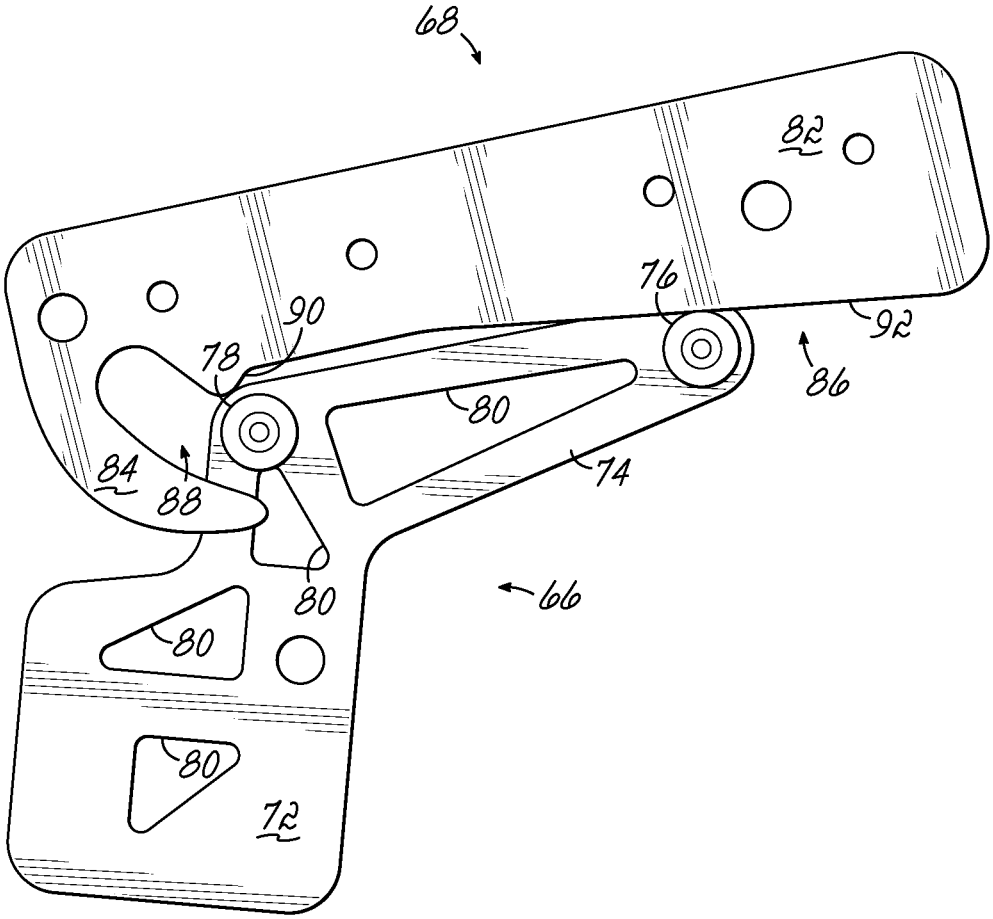
FIG. 13A is a view similar to FIG. 8A of the hook and cam components of the adjacent door panels of FIG. 13 continuing to disengage from each other.
Figure 14:
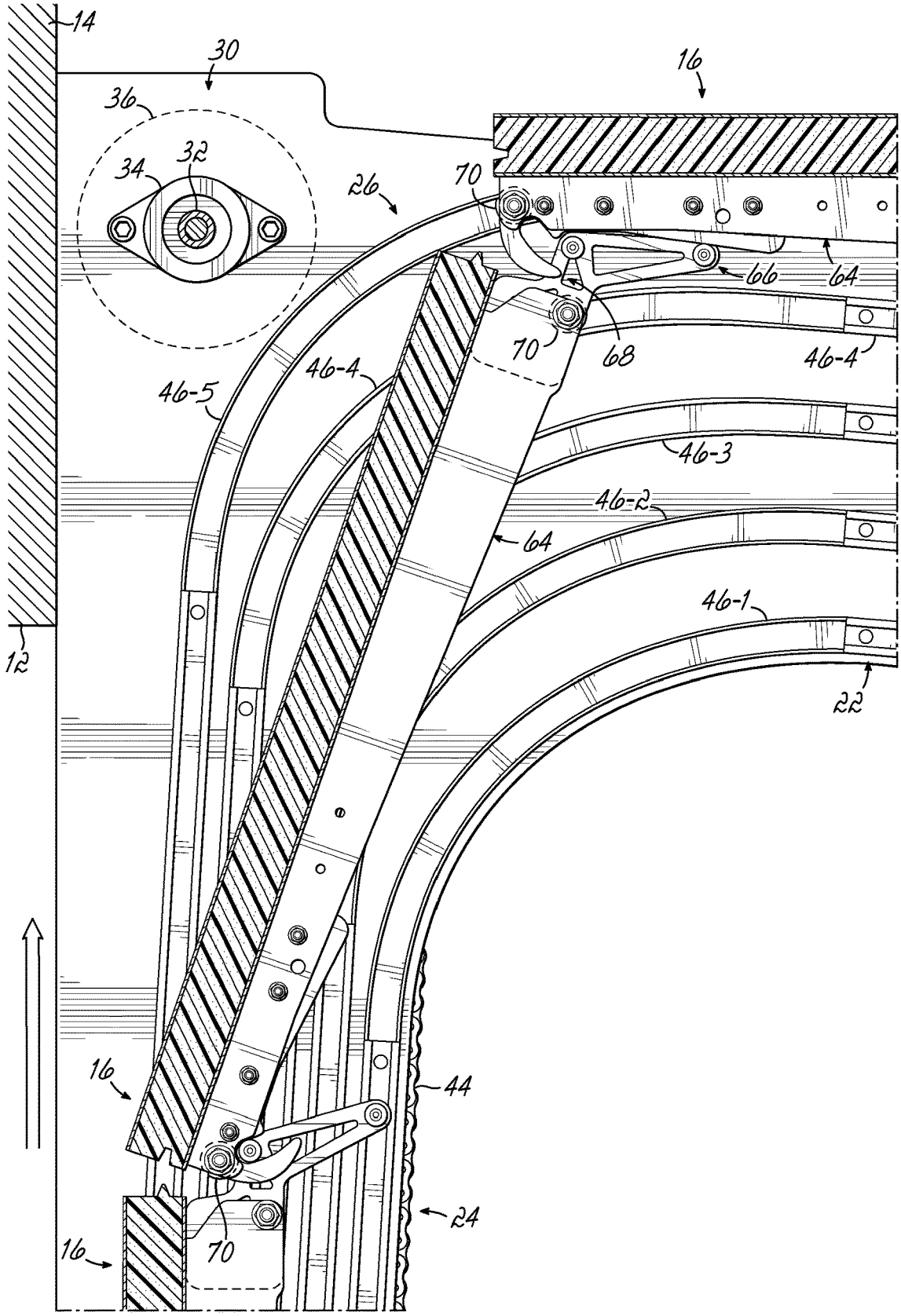
FIG. 14 is a view similar to FIG. 13 with the door panel adjacent to the uppermost door panel beginning to enter its associated horizontal track section.
Figure 14A:
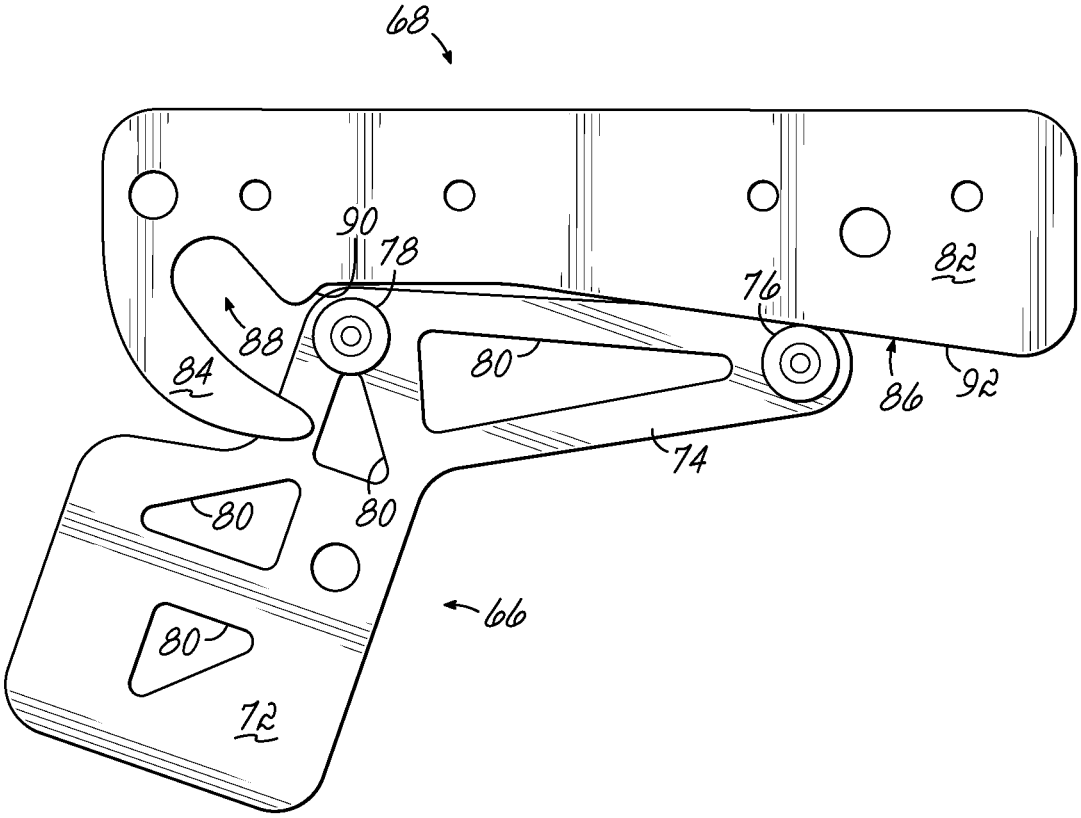
FIG. 14A is a view similar to FIG. 8A of the hook and cam components of the adjacent door panels of FIG. 14.
Figure 15:
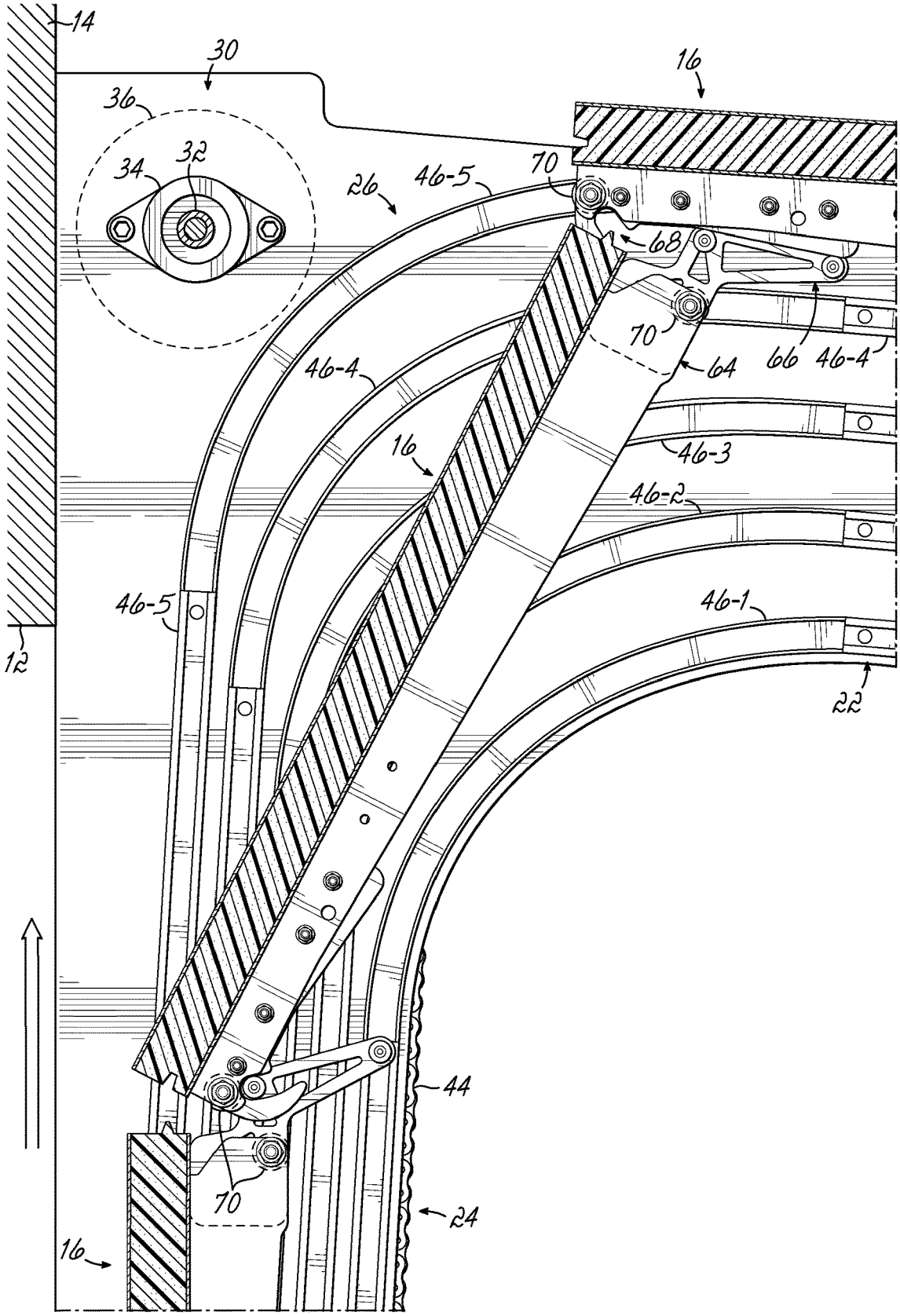
FIG. 15 is a view similar to FIG. 14 with the door panel adjacent to the uppermost door panel entering its associated horizontal track section.
Figure 15A:
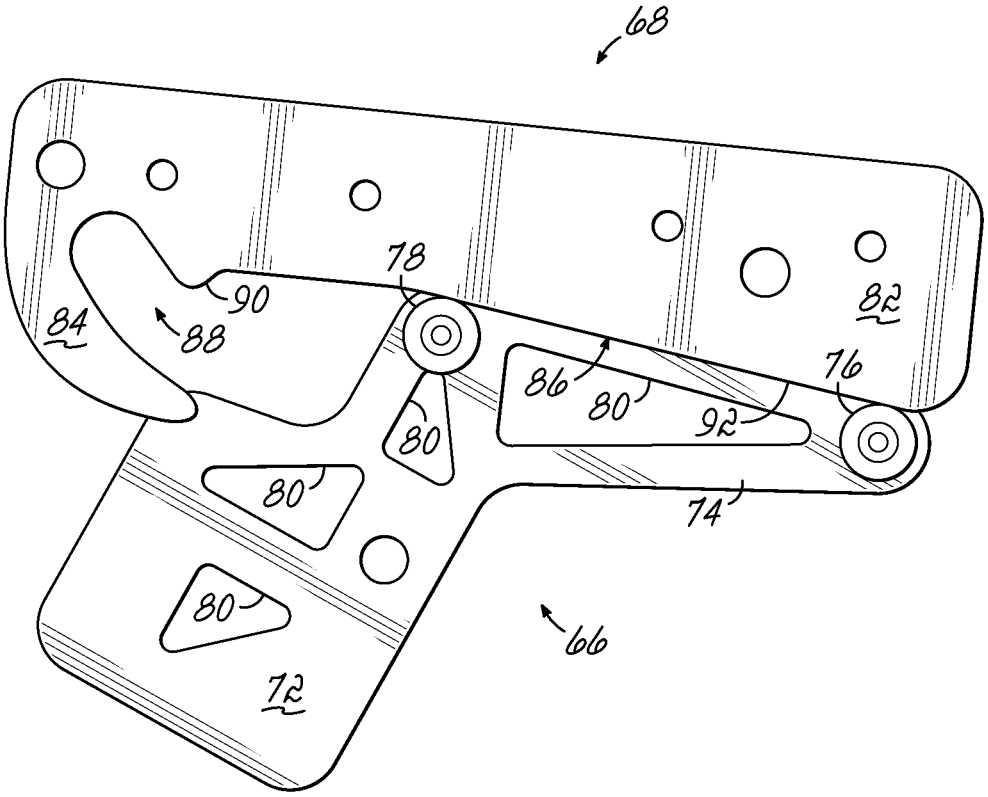
FIG. 15A is a view similar to FIG. 8A of the hook and cam components of the adjacent door panels of FIG. 15.

As shown in FIGS. 13-14A, continued upward movement of the door 10 results in the distal cam roller 76 on the cam assembly 66 of the subjacent door panel 16 approaching the trailing end of the cam surface 86 on the hook assembly 68 of the uppermost door panel 16 while the proximal cam roller 78 has passed the apex of the bump 90 on the cam surface 86. After passing the apex of the bump 90, the proximal cam roller 78 disengages from the cam surface 86 as it advances relative to the hook assembly 68 as shown in FIGS. 13A and 14A. Movement of the uppermost door panel 16 at this juncture continues along the horizontal track section 22 of the track 46-5 associated with that door panel while the track roller 70 of the cam assembly 66 on the subjacent door panel enters the horizontal section 22 of the track 46-4 associated with that door panel as shown in FIGS. 14 and 15. It will be appreciated that the joint between the second and third uppermost door panels has separated as the door panel adjacent to the uppermost door panel begins to pivot away from the wall 14 and toward a horizontal orientation.

Figure 16:
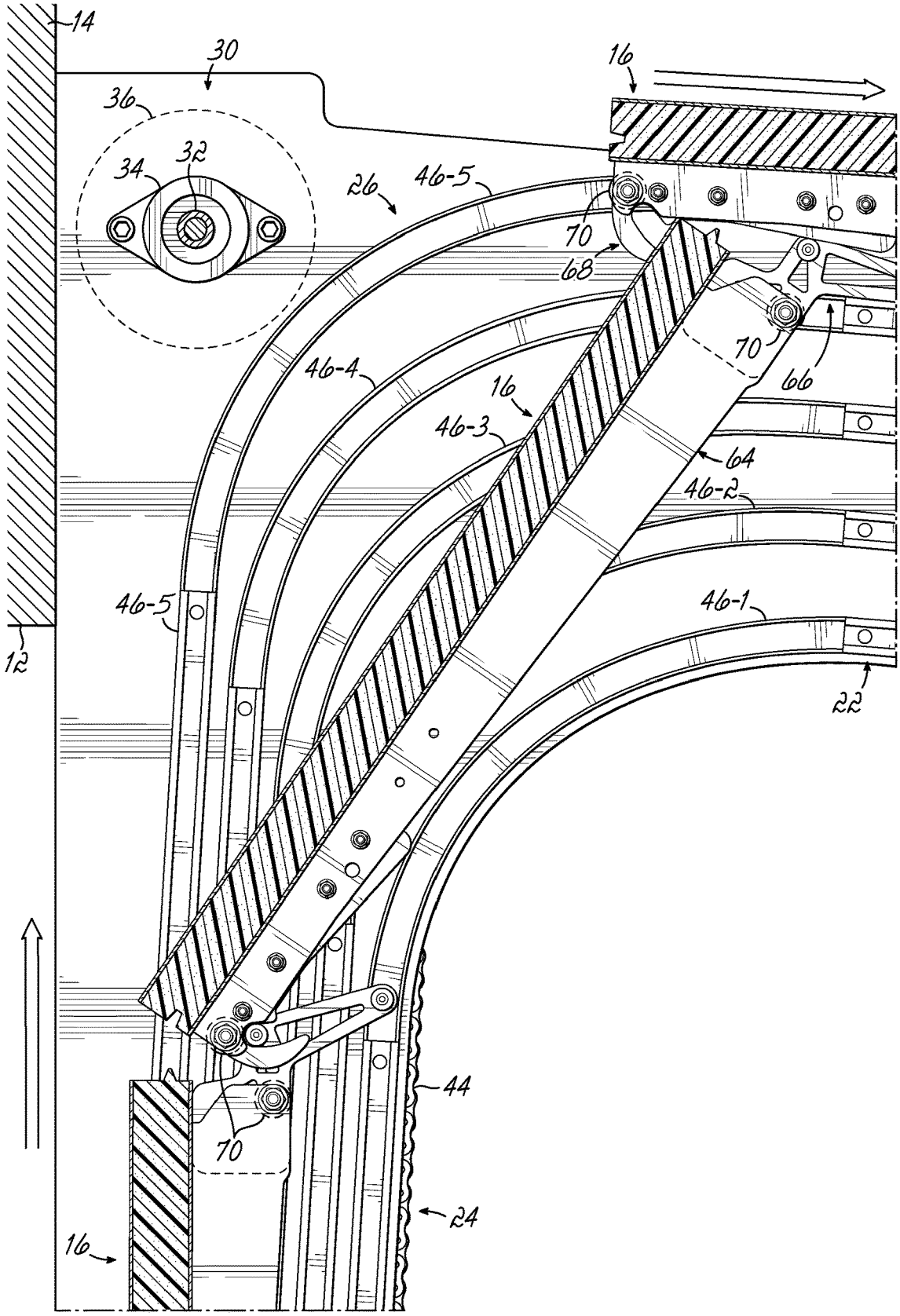
FIG. 16 is a view similar to FIG. 15 with the door panel adjacent to the uppermost door panel continuing to enter its associated horizontal track section and disengaging from the uppermost door panel
Figure 16A:
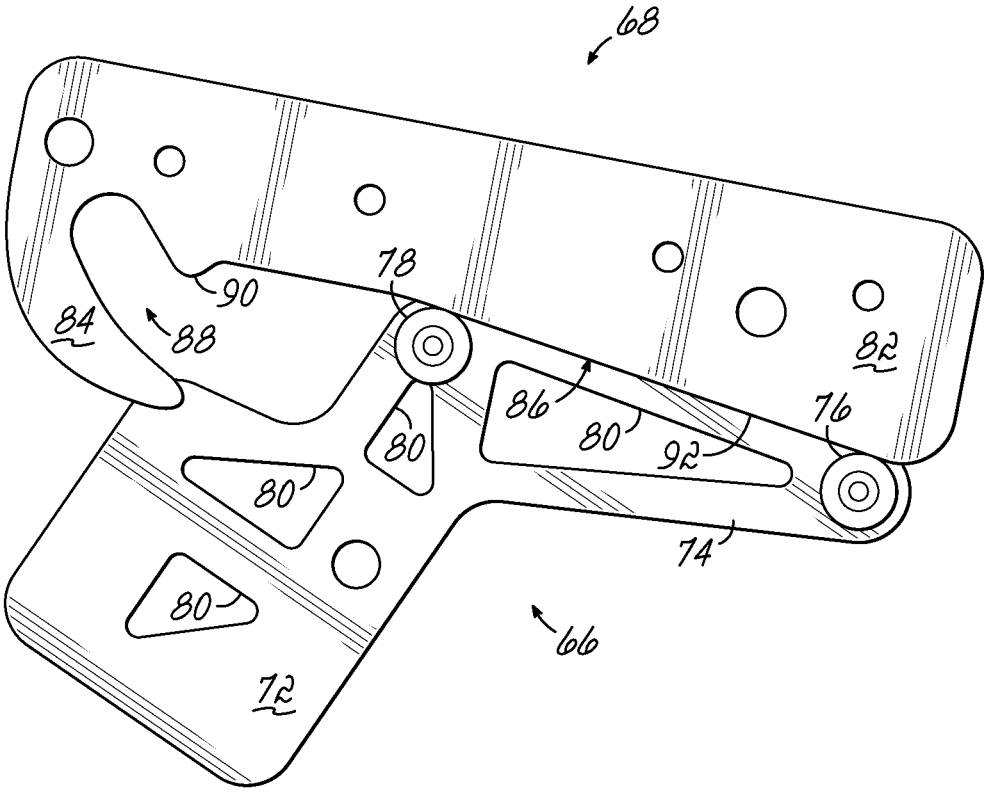
FIG. 16A is a view similar to FIG. 8A of the hook and cam components of the adjacent door panels of FIG. 16.

As shown in FIGS. 16 and 16A, continued opening of the door 10 results in both of the cam rollers 76, 78 advancing along the cam surface 86 of the hook assembly 68 on the uppermost door panel 16. Subsequent upward movement of the door panel immediately below the uppermost door panel will result in the cam rollers 76, 78 on the cam assembly 66 rolling off of the cam surface 86 thereby completely disengaging the uppermost door panel from the subjacent door panel as shown particularly in FIG. 17. Continued upward movement of the subjacent door panel advances the track roller 70 on the cam assembly 66 of that door panel 16 into the horizontal section 22 of the track 46-4 associated with that door panel as shown in FIG. 16.

Figure 17:
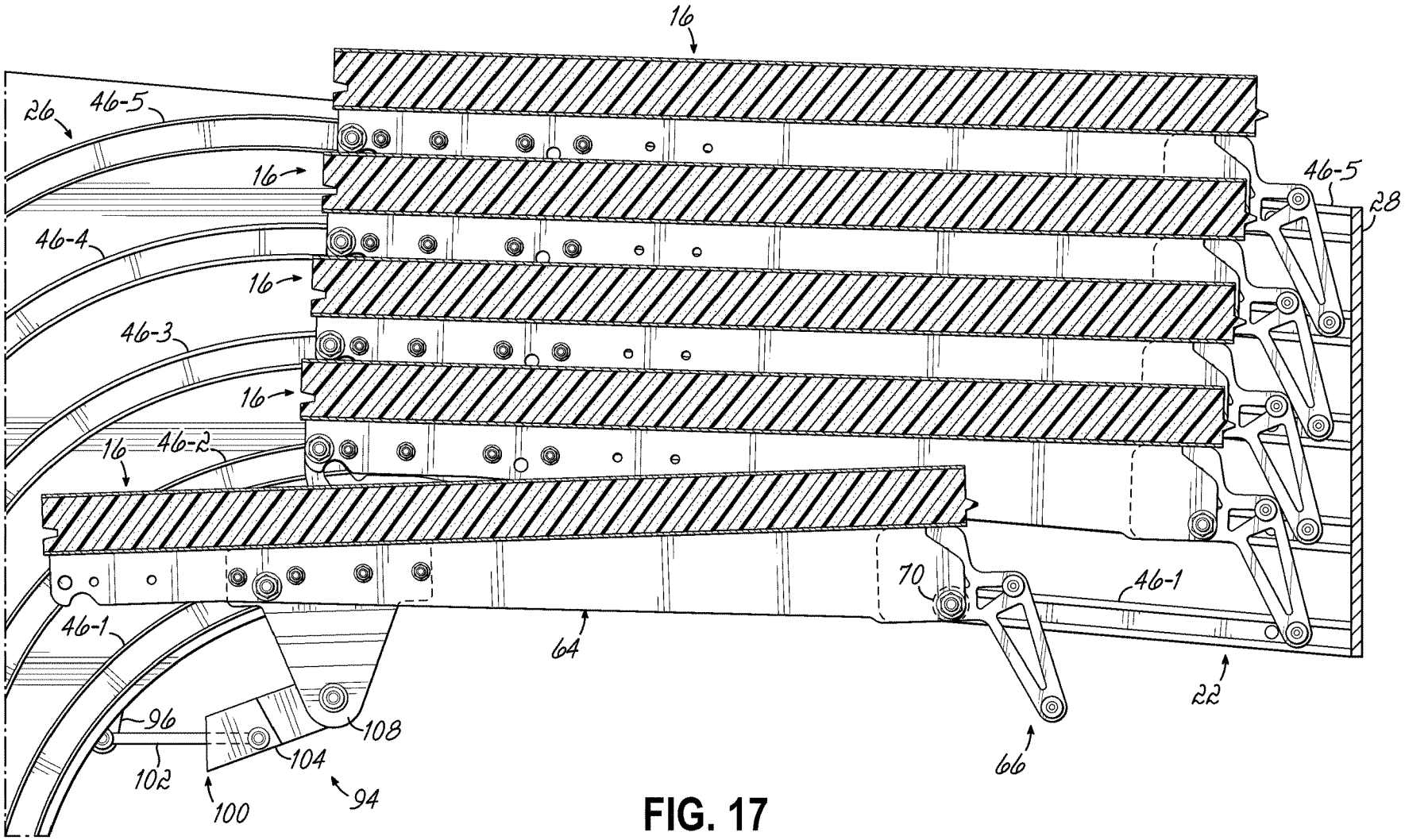
FIG. 17 is a side elevational view with the door panels in cross-section and all, but the lowermost door panel fully seated in its associated horizontal track section.

Subsequent upper movement of the door panel 16 results in the interaction between each pair of adjacent door panels 16 similar to that which was described with respect to the uppermost door panel and the door panel subjacent thereto. Ultimately, each of the door panels will disengage from the door panel immediately above it and seat within the horizontal track section 22 of the associated track 46 so that the door panels are aligned in a generally horizontal orientation relative to one another as shown in FIG. 17.

Figure 18:
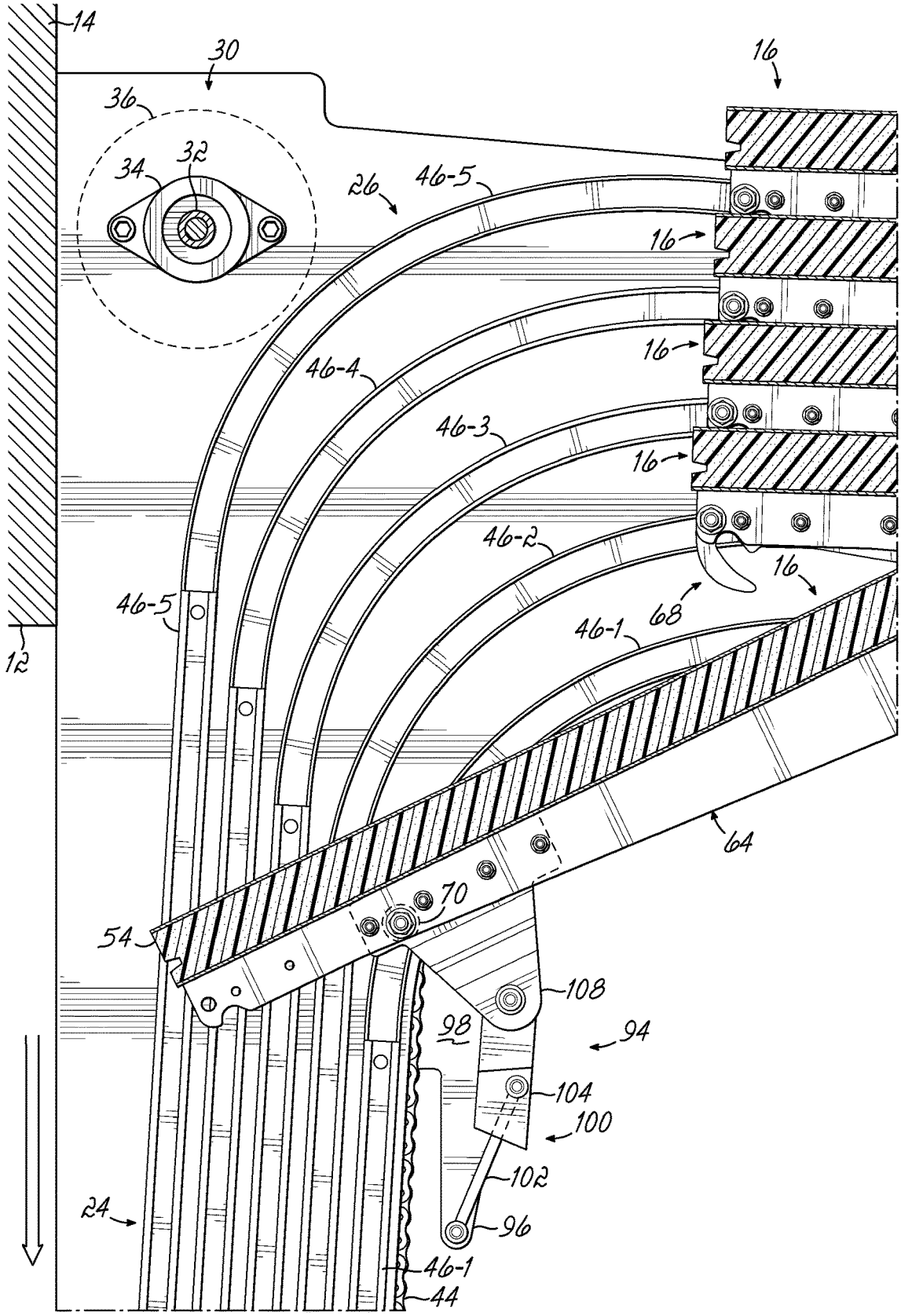
FIG. 18 is a view similar to FIG. 17 with the door closing from an open configuration and the lowermost door panel entering its transition track section.
Figure 19:
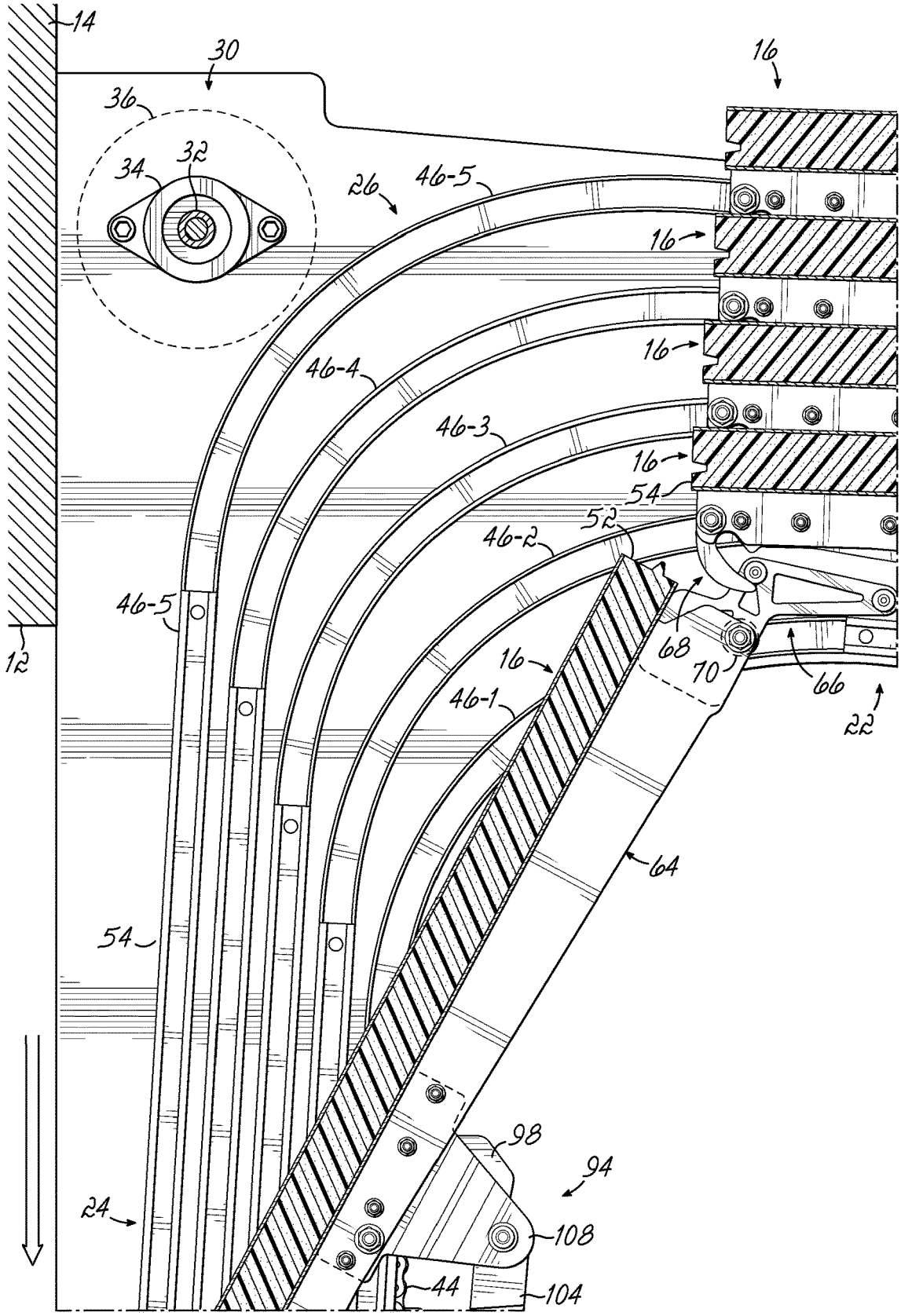
FIG. 19 is a view similar to FIG. 18 with the lowermost door panel entering its vertical track section.
Figure 19A:
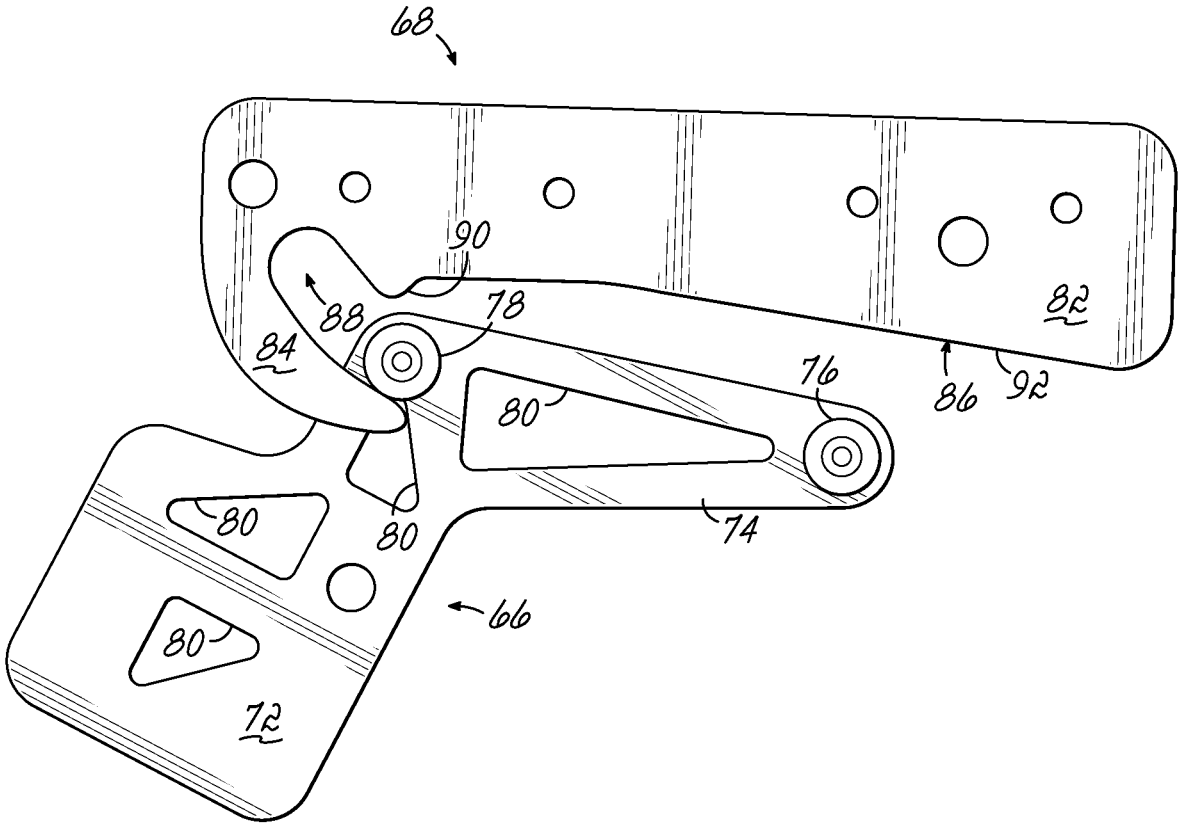
FIG. 19A is a side elevational view of the hook and cam of the two lowest door panels of FIG. 19 engaging one another.
Figure 20:
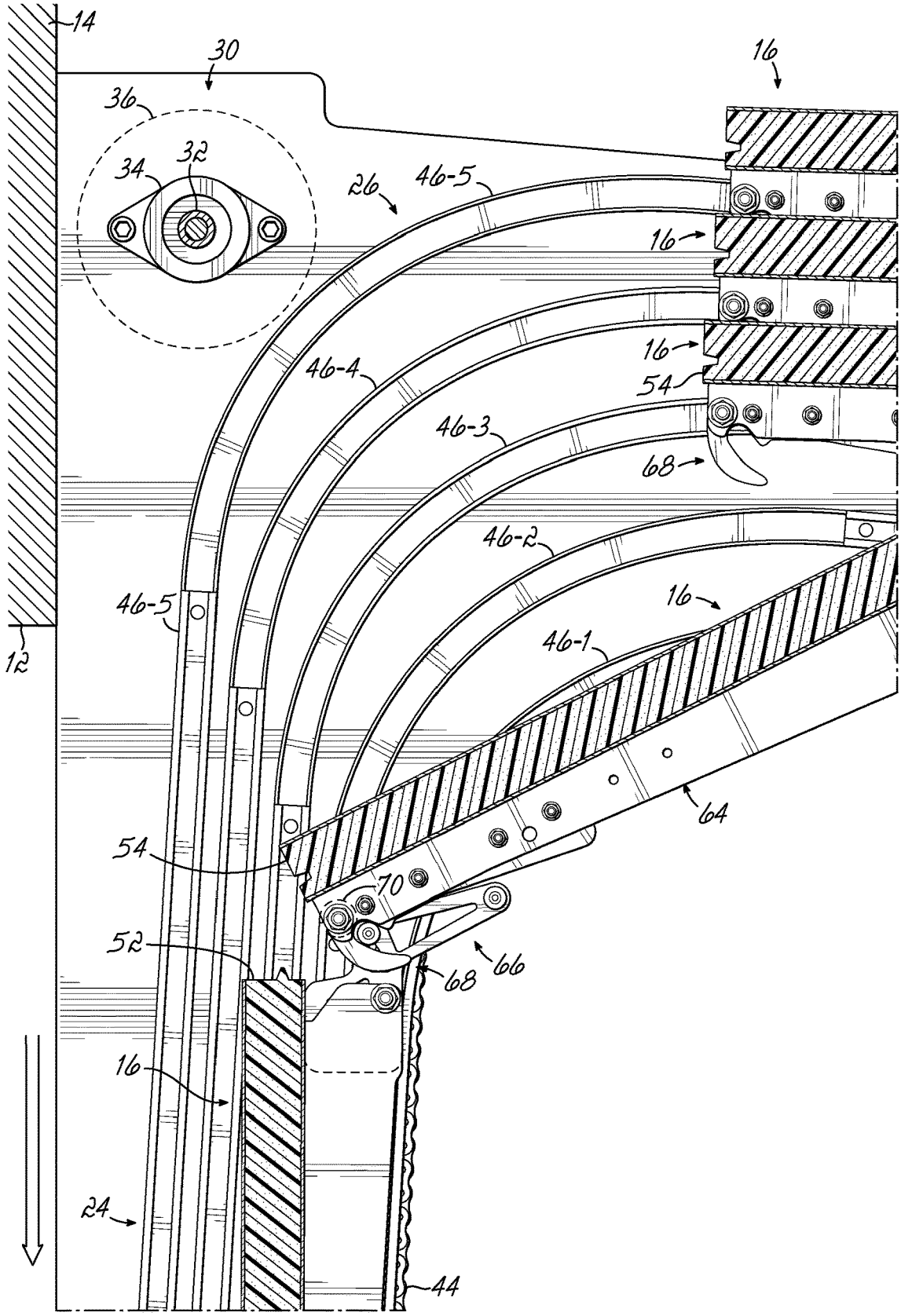
FIG. 20 is a view similar to FIG. 19 with the lowermost door panel in its vertical track section and the adjacent door panel in its transition section as the door is closing.
Figure 20A:
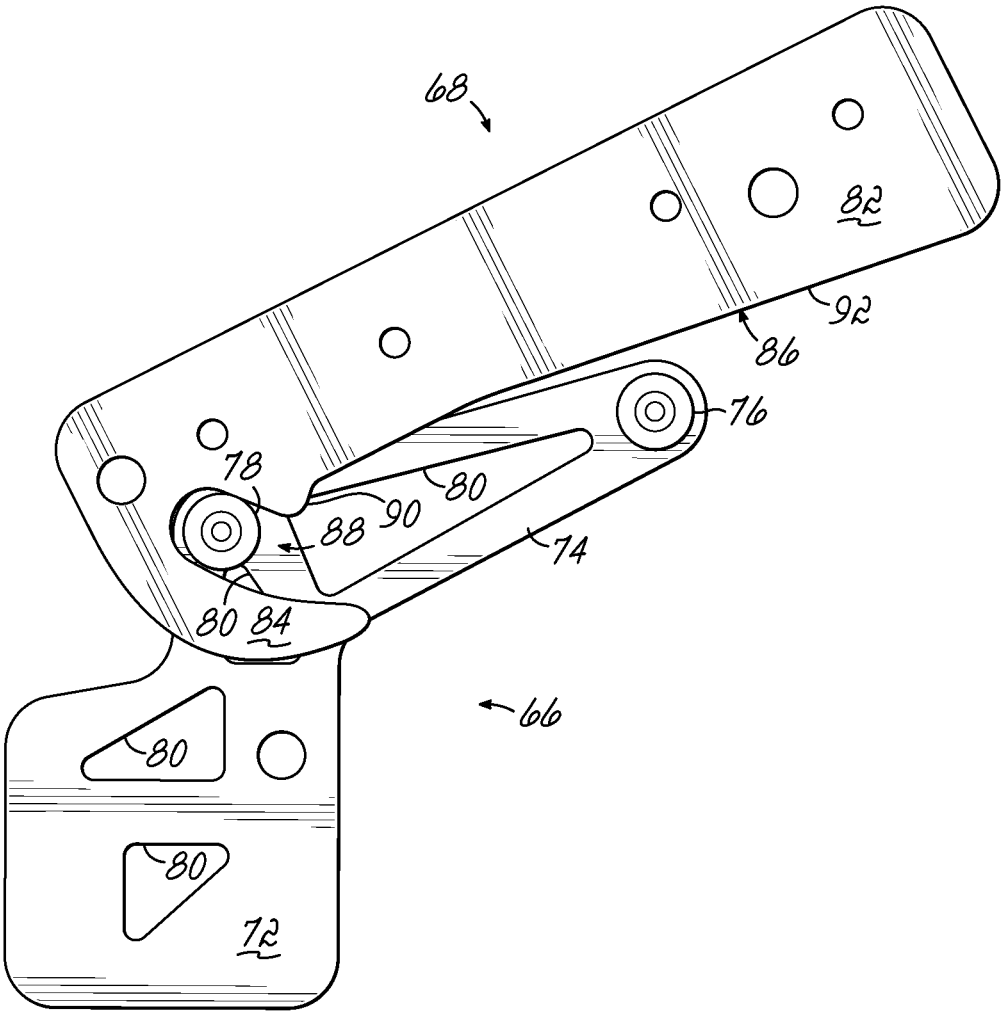
FIG. 20A is a view similar to FIG. 19A of the door panels of FIG. 20.

Movement of the door 10 from the open configuration toward the closed configuration covering the opening 12 in the wall 14 is introduced in FIGS. 18-20A with FIGS. 19A and 20A showing the sequential relative positions of the hook assembly 68 and cam assembly 66 at the joint between the lowermost door panel 16 and the door panel 16 superjacent thereto. Initial movement of the door 10 toward the closed configuration begins with the chain 44 advancing downwardly and thereby pulling the carriage assembly 94 adjacent the lower edge 54 of the lowermost door panel 16 downwardly as shown in FIG. 18. The track roller 70 on the carriage assembly 94 of the lowermost door panel travels from the transition track section 26 towards the vertical track section 24 of the track 46-1 associated with the lowermost door panel 16.

Subsequently, continued downward movement of the lowermost door panel advances the cam assembly 66 at the upper edge 52 of the lowermost door panel 16 to engage the hook assembly 68 of the door panel 16 immediately above the lowermost door panel 16 as shown in FIG. 19. In particular, as shown in FIG. 19A, the proximal cam roller 78 on the cam assembly 66 of the lowermost door panel 16 is hooked by the hook arm 86 of the hook assembly 68 on the door panel 16 immediately above the lowermost door panel 16. Continued downward movement of the lowermost door panel into the vertical track section 24 as shown in FIG. 20 likewise pulls the door panel 16 immediately there above from the associated horizontal track section 22 into and through the transition track section 26 to enter the vertical track section 24 associated with that door panel 16. As shown in FIG. 20A, the hook arm 84 of the second lowest door panel 16 captures the proximal cam roller 78 of the lowermost door panel 16 thereby pulling the superjacent door panel 16 downwardly toward the closed position.

Continued movement of the lowermost door panel 16 downwardly likewise pulls each subsequent door panel downwardly from the horizontal track section 22 through the transition track section 26 to the vertical track section 24 of the track 46 associated with the respective panel 16. The proximal cam roller 78 of each subjacent door panel 16 is captured by the hook arm 84 of each superjacent door panel 16 to thereby engage the door panels one with another for the closing operation.

As shown in FIGS. 21-26, one embodiment of a counterbalance system 100 for use with the door 10 according to this invention is shown. There are a number of known counterbalance systems in use with high speed doors. These include torsion and extension springs and weights. Torsion springs are not well suited for high cycle operation. To accomplish a higher life cycle, torsion springs have to become very bulky. This makes it difficult to design a high cycle torsion spring system within the drive line. Extension springs are an improvement over torsion springs in that they can more easily be configured into tighter spaces. Spring packs of multiple springs seated within one or both columns adjacent the vertical track section on each side of the door allow for the spring forces to be finely tuned. However, in known systems high stress areas are introduced and failure typically occurs much sooner than the theoretically predicted intervals. Also, a failed spring when fully energized can become dangerous. With both torsion and extension springs in the prior art, the failure of a single coil represents failure of the entire system. Weights do have the benefit of high life-length; however, they too can be dangerous during installation and service and can cause damage to equipment if failure occurs.

The benefit of a counterbalance system 100 according to various embodiments of this invention is that it allows for drives with less power to operate doors at high speed. The counterbalance system 100 according to this invention uses a compression spring system which has advantages over other types of spring systems. The compression spring system has the same advantages as the extension spring system with the added advantages of much higher life and safer operation.

A long compression spring can be used by guiding it along a tube through the center of the spring. This prevents bucking of the spring during compression. In the event a spring coil breaks, the door 10 is still completely operable as only a small fraction of the load is lost. If a coil breaks, because it is contained by a tube through the center, collateral damage is avoidable. Very high cycles are possible in part because there are no high stress areas.

Spring packs 104 may be configured such that they are modular in design. The modular design enables the installer and/or service provider to remove the spring pack 104 from the vertical columns in its entirety (after the tension has been removed). This feature can allow for lighter weight assembly/construction and/or ease of service as needed. The modular design of the spring packs 104 also provides the option to configure/customize the arrangement of the tubes and spring compression "K" factor to account for the wide range of door sizes and panel weights. According to one aspect the spring pack of various embodiments of this invention, the springs in a spring pack are arranged in parallel so as to compress and extend together with one another as opposed to being linked end to end in series.

The spring pack 104 may also utilize a double slide feature to reduce overall force applied to the guide tubes to minimize bearing wear for longer projected use without service. The bottom spring carriage may be guided by the tubes and is raised via a polyester belt 134 that winds around a shaft connected to the main drive line. This belt 134 is wound counter to the direction of the door load providing a zero net torque throughout the door motion path.

The design of the bottom bracket, lifting arm and chain carriage allows for the full horizontal positioning of the bottom panel in the open position, clearing the opening height, while still allowing for the track radius to extend below the opening height. This minimizes the amount of headroom required to transition from vertical (closed) position to horizontal (open) position. This also allows for the use of a fully linear lift line for the entire lifting stroke.

While the bottom section is vertical, the load is transferred through the cam follower on the bottom bracket into the carriage, directly in line with the chain tension, thereby eliminating any moment load on the carriage. As the bottom section transitions to horizontal, the linkage takes over and gives the section the final push to its seated position. Linkage is hinged so that while cam follower is in slot, the linkage is not loaded. The slot has a lead in which serves to bend the linkage to this unloaded state when transitioning from horizontal to vertical section position.

At the top position, there is not a lot of movement of the section relative to carriage movement, so opening distance is not sensitive to absolute accurate position of carriage travel.

Figure 21:
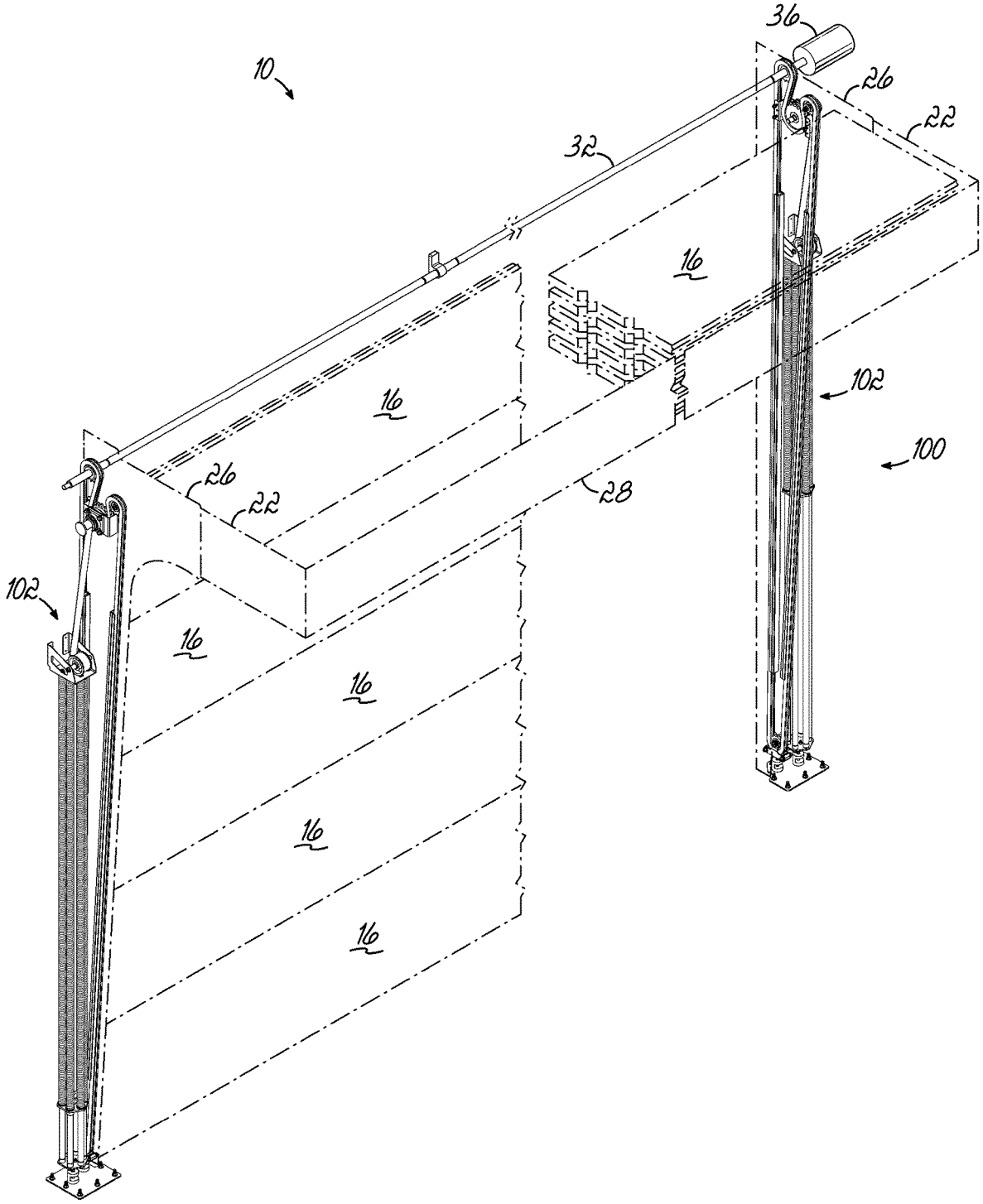
FIG. 21 is a perspective view of one embodiment of a counterbalance system for use with a door according to this invention.

Referring to FIG. 21, the counterbalance system 100 utilizes the counterbalance rod 32 mounted above the opening 12 for the garage door 10. As previously discussed with respect to FIG. 1, the counterbalance rod 32 is coupled to a counterbalance operator, drive or motor 36 for rotation of the rod 32 during the opening and closing of the door 10 which is assisted by the counterbalance system 100 as shown in FIGS. 21-26. The counterbalance system 100 includes two counterbalance subsystems 102 each mounted on one lateral side edge of the door 10 as shown in FIG. 21. The two counterbalance subsystems 102 are mirror images of one another and, as such, only one of the subsystems 102 will be described in detail herein.

The counterbalance subsystems 102 work in unison to assist in raising and lowering the door 10. Each counterbalance subsystem 102 includes a spring pack 104 which has an upper spring pack bracket 106 and a lower spring pack bracket 108. A number of springs 110 are included in each spring pack 104 and extend between the upper and lower spring pack brackets 106, 108. In the embodiment shown in FIGS. 21-26 herein, six compression springs 110 are shown mounted between each pair of upper and lower spring pack brackets 106, 108. The compression springs 110 are shown in different configurations in the two subsystems 102 shown in FIG. 21 with the subsystem 102 on the right showing the spring pack in a configuration compatible with the door 10 being open and the panels 16 stacked in a generally horizontal orientation while the counterbalance subsystem 102 on the left shows the spring pack 104 with the door 10 in the closed position with the panels 16 stacked on edge one upon another. The upper spring pack bracket 106 has a pair of spaced flanges 112 with each flange mounted to the wall 14 adjacent the door opening 12 via appropriate screws, nails, bolts or other such fasteners. Therefore, the position of the upper spring pack bracket 106 is fixed relative to the wall 14 surrounding the door opening 12.

On the other hand, the lower spring pack bracket 108 moves vertically during the opening and closing of the door 10. The lower spring pack bracket 108 is mounted for generally vertical movement along a number of posts 114 each of which extends through the lower spring pack bracket 108 and one of the compression springs 110. Appropriate collars or bushings may be included in the lower spring pack bracket 108 to facilitate the sliding movement of the spring pack bracket 108 relative to the respective posts 114. An upper end of each post 114 is mounted to the upper spring pack bracket 106 and a lower end of each post 114 is mounted on a fixed lower spring pack bracket 116.

Figure 24:
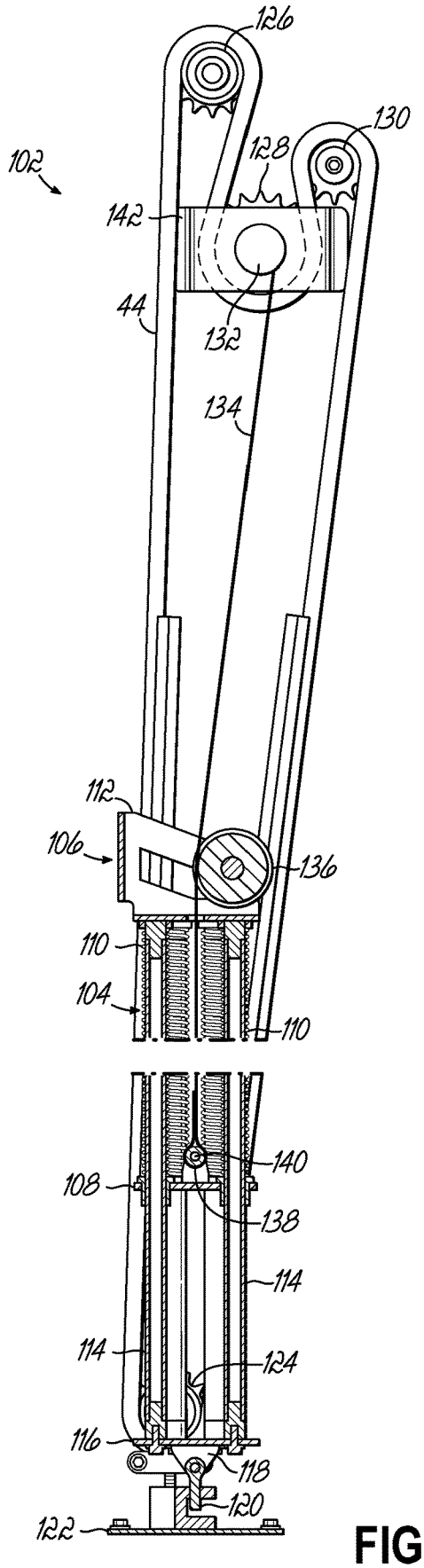
FIGS. 24-26 are side elevational partial cross-sectional views of the spring assembly of FIGS. 22-23.

As shown particularly in FIG. 24, a flange 118 extends downwardly from the fixed lower spring pack bracket 116 and has a pin 120 extending downwardly therefrom. The pin 120 is engaged with and secured to a mount 122. The mount 122 is bolted or otherwise secured to a floor beneath the door opening 12 as shown generally in FIG. 21. The mount 122 and pin 120 fix the position of the lower fixed spring pack bracket 116.

Figure 25:
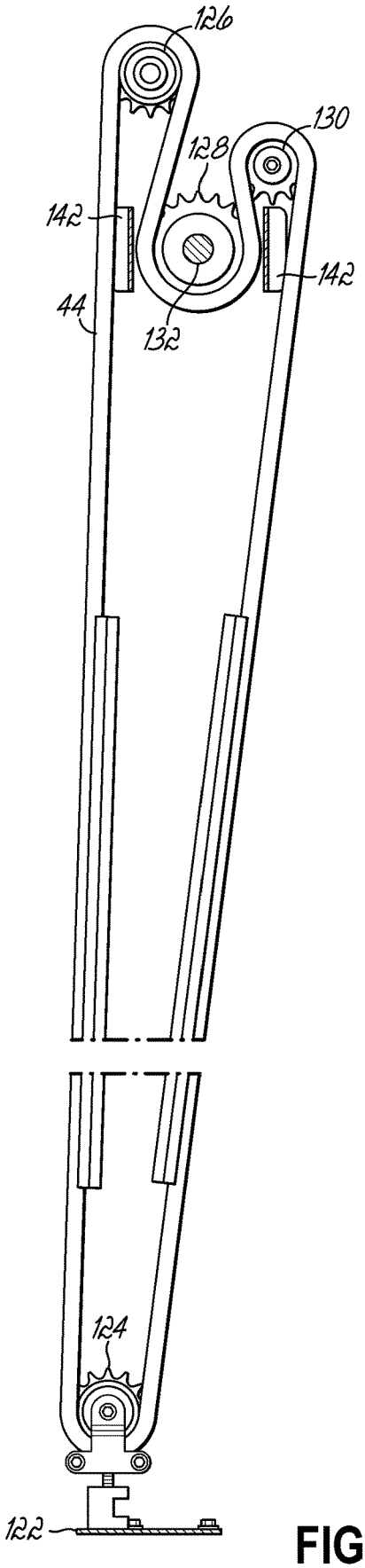
Figure 26:
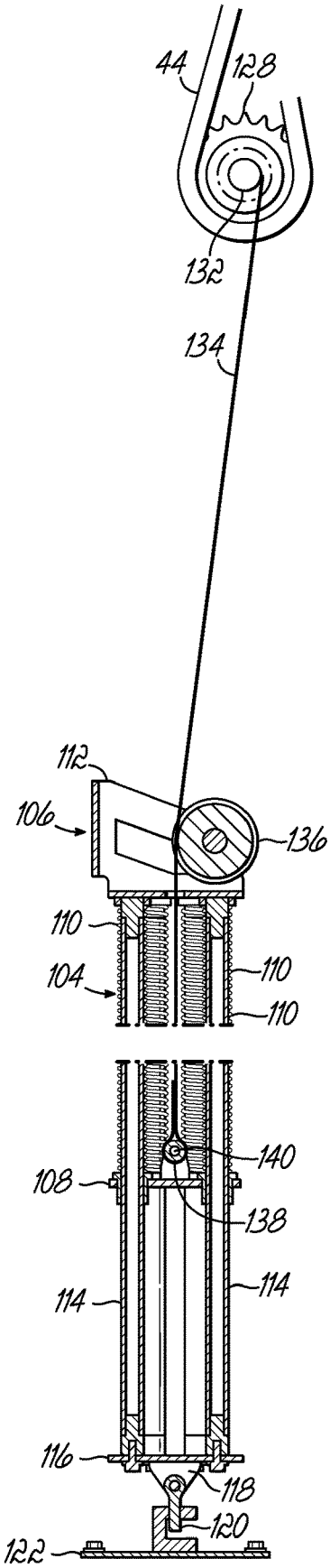

Each counterbalance subsystem 102 also includes the chain 44 which is coupled to the carriage bracket 98 which moves with the chain 44 around a number of sprocket wheels 124, 126, 128, 130 as shown in FIGS. 24-25. In FIG. 25, the spring pack 104 is removed for clarity of the chain 44 and sprocket wheels. A lower sprocket wheel 124 is mounted for rotation in the fixed lower spring pack bracket 122. The chain 44 extends upwardly from the lower sprocket wheel 124 and is trained around a driven sprocket wheel 126, an intermediate sprocket wheel 128 and an idler sprocket wheel 130. The driven sprocket wheel 126 is mounted on the counterbalance rod 32 and is rotationally driven by the counterbalance operator or motor 36 via the counterbalance rod 32. Extending laterally outwardly from the intermediate sprocket wheel 128 is a belt take-up roller 132 which is mounted on the axis of rotation of the intermediate sprocket wheel 128.

The belt take-up roller 132 has a belt 134 trained around the roller 132 and extending downwardly through the upper spring pack bracket 106 about an idler belt roller 136. A loop 138 at the lower end of the belt 134 is fixed to a lug 140 mounted on the lower spring pack bracket 108 as shown in FIG. 24. The intermediate sprocket wheel 128 and belt take-up roller 132 are mounted for rotation in a sprocket bracket 142 which is mounted to the outer face of the transition section 26 of the track system 20 and below the counterbalance rod 32 as shown in FIG. 21. The path of the belt is shown most particularly in FIG. 26 with a lower end loop 138 secured to the lug 140 of the lower spring pack bracket 108. The belt 134 extends upwardly through the spring pack 104 and against the belt idler roller 136 on the upper spring pack bracket 106 and is trained around the take-up roller 132.

While the counterbalance system 100 is shown and described herein with compression springs, other embodiments of this aspect of the invention may utilize other devices, including, but not limited to, extension springs, torsion springs, and counterbalance weights.

Figure 22:
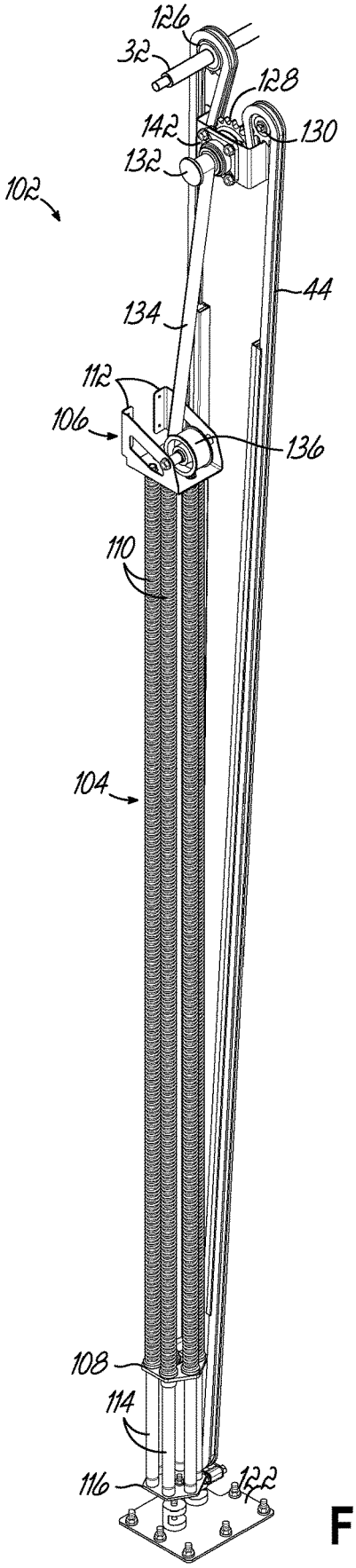
FIGS. 22 and 23 are each perspective views of a counterbalance spring assembly and associated mechanisms of the embodiment in FIG. 21.
Figure 23:
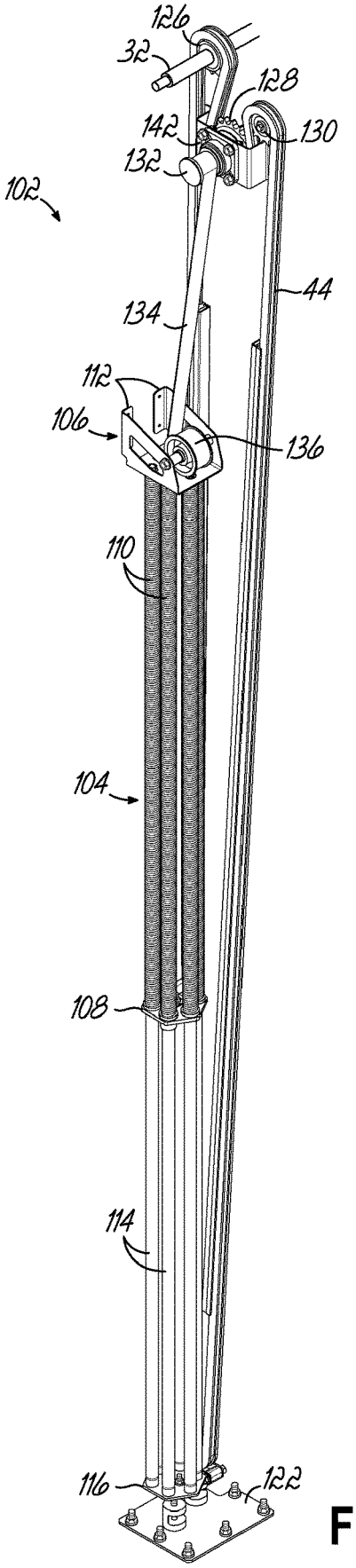

The operation of the counterbalance system 100 according to this embodiment of this invention is as follows. With the door 10 in the open position, the spring pack 104 of each counterbalance subsystem 102 is extended as shown in FIG. 22. Movement of the door 10 into the closed position compresses the springs 110 of each spring pack 104 toward the configuration shown in FIG. 23. The carriage bracket 98 fixed to the lowest panel 16 of the door 10 moves with the chain 44 during the opening and closing operations. As the carriage bracket 98 and associated portion of the chain 44 moves downwardly, the chain 44 moves around the various sprocket wheels 124, 126, 128, 130 and the weight of the door 10 is counterbalanced by the compression springs 110 of each spring pack 104. The weight of the door 10 is counterbalanced via the belt 134 which is fixed to the lower bracket 108 of the spring pack 104 and rotation of the driven sprocket wheel 126 and intermediate sprocket wheel 128 takes up the belt 134 which is wrapped around the take-up roller 132 coupled to the intermediate sprocket wheel 128 as shown in FIG. 24.

During the opening operation of the door 10, the weight of the door 10 is counterbalanced by the compression springs 110 of each spring pack 104 and the opposite rotation of the counterbalance rod 32 and driven sprocket wheel 126 in relation to the closing sequence of the door 10 likewise assists in the door closing operations. Since the springs 110 are compression springs, energy is required to compress them from the configuration shown in FIG. 22 to the configuration shown in FIG. 23. The energy required for compressing the springs 110 is a result of gravity acting on the mass of the door 10 during the closing operation to compress the springs from the configuration shown in FIG. 22 to the configuration shown in FIG. 23.

It will be appreciated that the particular spring parameters, the arrangement of the springs 110 and the quantity of the springs 110 utilized in the counterbalance subsystem 102 may be designed specifically for a particular door configuration and door parameters. While each spring pack 104 herein is shown with six springs 110, a different quantity of springs 110 may be utilized. Extension and compression of the springs no is guided by the posts 114 each of which extends through one of the springs 110. While six posts 114 may be provided, more or less than six springs 110 and associated posts 114 may be mounted in each spring pack 104 depending on the parameters of the counterbalance subsystem 102 and associated door 10.

Figure 27:
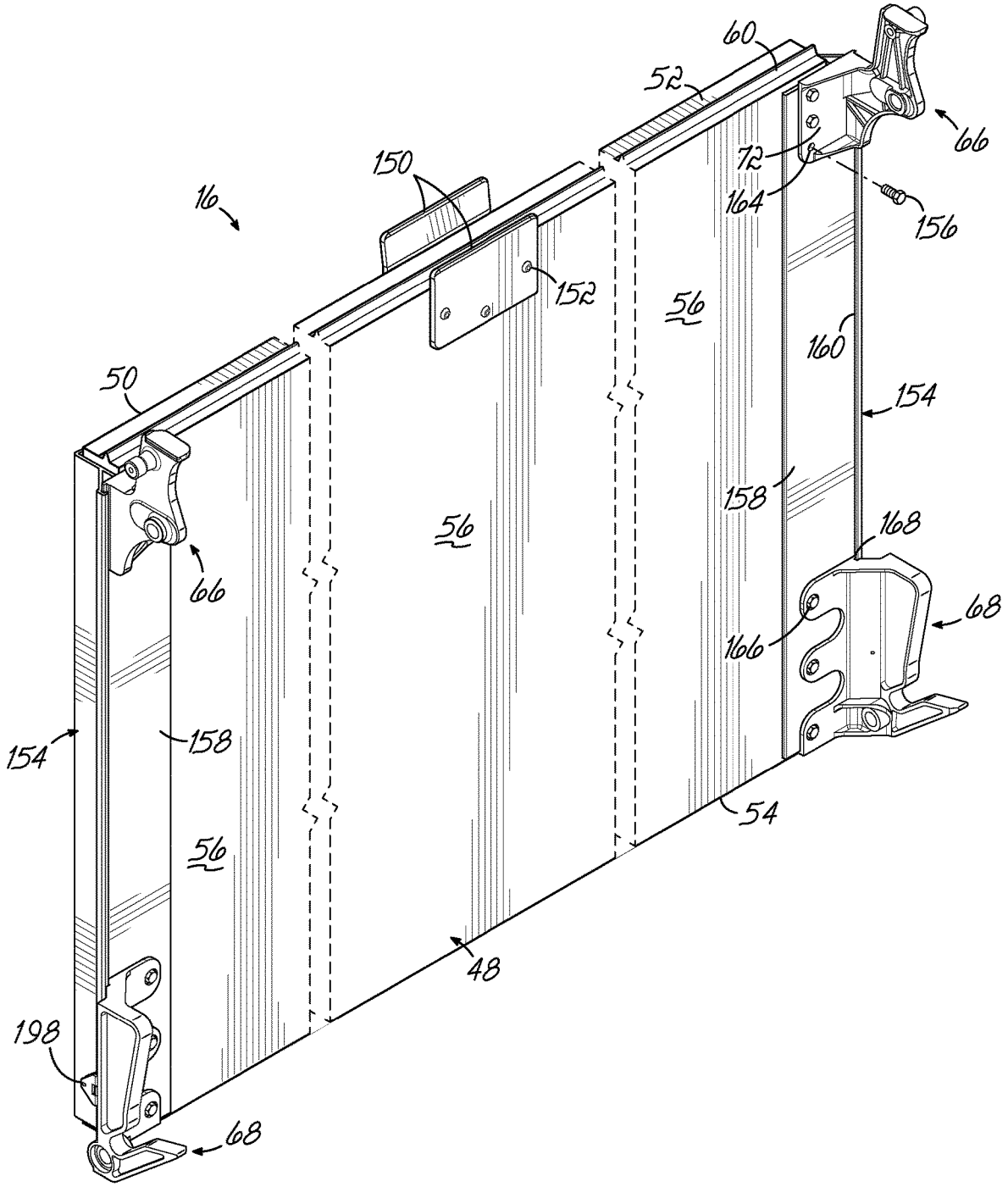
FIG. 27 is a perspective view of another embodiment of a door panel and associated components according to this invention.

Another embodiment of the door panel 16 according to this invention is shown in FIG. 27. As noted previously, the panels 16 according to this invention are not joined together by hinges as in traditional sectional overhead doors. Once the panels 16 of this invention are assembled, there is still a need to stack the panels 16 in the vertical plane when the door is closed. The door system 10 according to various embodiments of this invention does not include a center connection between the panels 16 as system 10 is hinge-less. To avoid misalignment at the center of the panels 16 when transitioning to the vertical (closed) orientation, panel guides 150 may be included as shown in FIG. 27. The panel guides 150 are designed to minimize the misalignment of the panels 16 which could damage the mating tongue 60 and groove 62 nesting of the adjacent longitudinal edges of the panels 16. Panel guides 150 may be secured on both faces 50, 56 of the panel 16 and are centered longitudinally to offer guidance to the preceding panel 16 as the two panels 16, 16 mate when being pulled from the nested or open position of the door 10 to the closed position. Each panel guide 150 may be secured to the associated face 50, 56 of the respective panel 16 by mechanical fasteners 152 such as screws or other fasteners.

The door panel 16 of FIG. 27 also shows an alternate embodiment of the cam assembly 66. The embodiment of the cam assembly 66 shown in FIGS. 1-20 utilizes a two roller configuration, including a first, distal cam roller 76 and second, proximal cam roller 78. In an alternate embodiment, a single roller 76 is utilized on the cam assembly 66 in the embodiment shown in FIGS. 27-30 to engage the hook assembly 68 during opening and closing operations. The hook assembly 68 of the panel 16 shown in FIG. 27 engages the roller 76 on the cam assembly 66 during movement of the door system 10 to and between the open and closed positions as is described in detail with respect to the embodiment shown in FIGS. 1-20.

Figure 28:
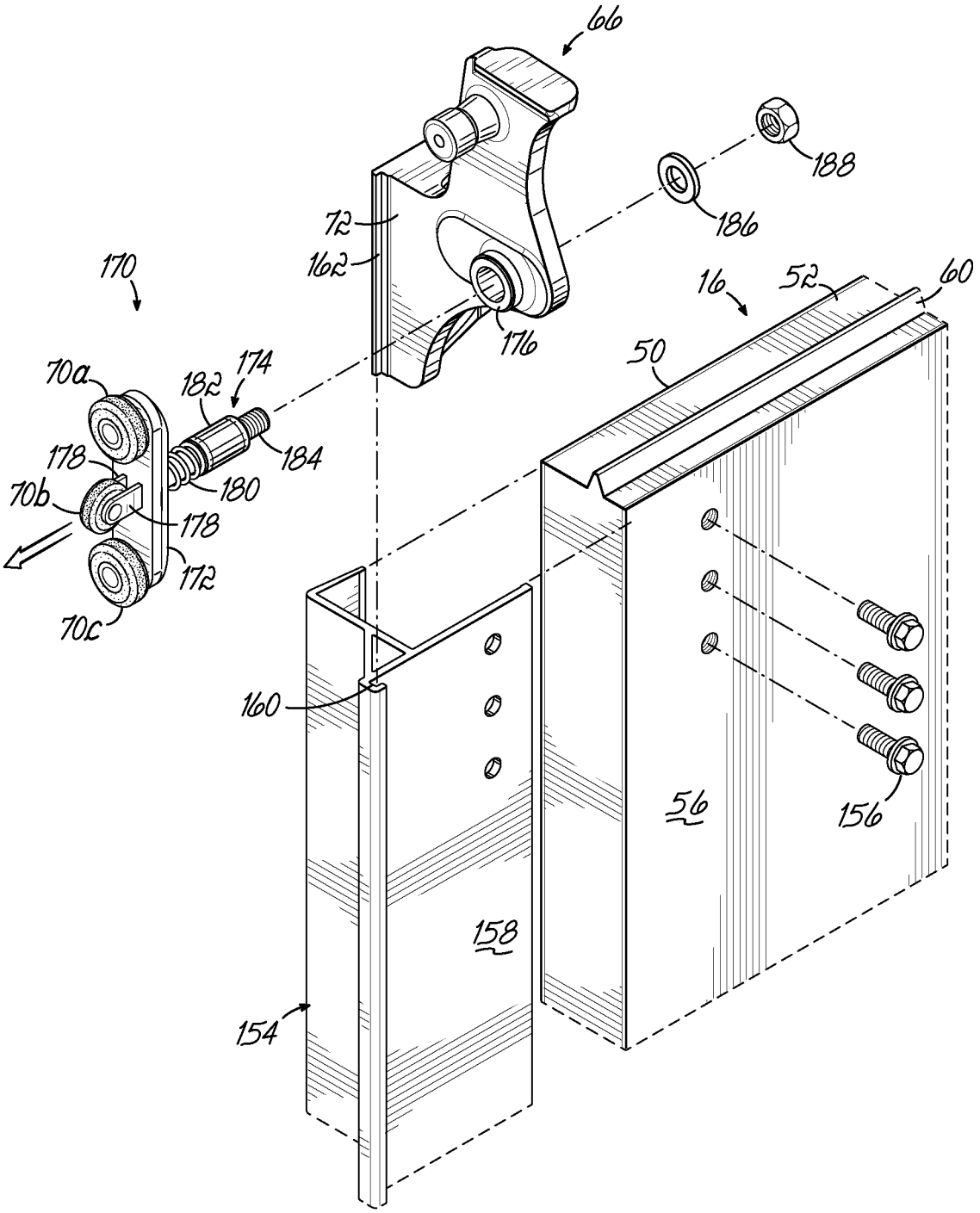
FIG. 28 is a partially exploded, perspective view of a cam and an end rail component of the door panel of FIG. 27.

As shown in FIG. 28, the panel 16 of this embodiment includes an end stile 154 on each longitudinal end of the panel 16. The end stile 154 serves as an end cap to the panel and may be secured to the panel 16 by mechanical fasteners 156 such as screws inserted through a flange 158 of the end stile as shown in FIG. 28. The end stile 154 of this embodiment of the panel 16 also includes a channel 160 projecting from the flange 158 along the length of the end stile 154. The channel 160 is adapted to capture a lip 162 extending from the cam assembly 66 as shown in FIG. 28 to allow for vertical positioning of the cam assembly 66 on the end stile 154. Apertures 164 are provided in the cam body 72 to receive the fasteners 156 which likewise secure the end stile 154 to the panel 16. Similarly, as shown in FIG. 27, mechanical fasteners 166 such as screws or the like are used to secure the hook assembly to the end stile 154. The hook body 82 also includes a projecting lip 168 which is captured in the channel 160 on the end stile 154.

The transition sections 26 of the track system 20, have a radius or curvature. The cooperating cam assembly 66 and hook assembly 68 allows for the progression of a panel 16 from the vertical sections 24 of the track system 20 to the horizontal sections 22. With the tongue 60 and groove 62 structures of the panels 16, disengagement separates the preceding panel 16 from the subsequent panel 16. The cam and hook system helps facilitate that separation in the transition tracker sections 26.

Each door panel 16 is coupled to a dedicated track 46 as previously noted. Each panel 16 is guided via the track roller 70 through the track system 20. The track rollers 70 in the roller system of the panel 16 shown in FIGS. 27-28 may have two types of rollers: load-bearing rollers and stabilizing rollers. The load-bearing rollers are oriented to travel along the track system 20. The load-bearing rollers also offer load transfer from wind in the static and dynamic conditions.

The roller system according to the embodiment shown in FIGS. 27-30 may include a roller carriage 170 with a carriage body 172 to which the rollers are mounted. The roller carriage 170 is mounted to the cam assembly 66 via an axel 174 seated in a bushing 176 in the cam body 62. The axel 174 defines a pivot axis about which the roller carriage 170 may pivot while guiding the panel 16 through the track system 20. The carriage body 170 has three rollers **70*a*, 70*b***, 70*c* mounted to it according to one embodiment of this invention. Each of the rollers 70*a*, 70*b*, 70*c* is captured in the track system 20 to guide the panel 16 to and between the closed and open positions. The rollers 70*a*, 70*b*, 70*c* are arranged generally vertically when the door is closed position and the middle roller 70*b* is a stabilizing roller and the outboard rollers 70*a* and 70*c* are the load bearing rollers. The stabilizing roller 70*b* is mounted for rotation between a pair of flanges 178 projecting from the carriage body 172 about an axis generally perpendicular to the rotation axes of the rollers 70*a* and 70*c* as shown in FIG. 28. The stabilizing roller 70*b* is biased by a spring 180 mounted on the axel 174 between the carriage body 170 and a journal 182 also on the axel 174. The axel 174 includes a threaded end 184 which is inserted through the bushing 176 on the cam body 72 and the threaded end 184 receives a washer 186 and a nut 188 to secure the roller carriage 170 to the cam body 72.

The stabilizing roller 70*b* is biased by the spring 180 and pushes away from the panel 16 in the track 20. The stabilizing roller 70*b* is thus spring loaded and provides a centering effect for the panel 16. Typical sectional doors tend to drift to one side giving rise to increased wear of the cables or rollers. The spring loaded stabilizing roller 70*b* maintains the panel 16 in an optimized position to reduce the wear that can result from drift.

The cam body 72 may be metal and the track system 20 may be aluminum and the configurations of these complementary components are designed to work in conjunction under wind load conditions. The track 20 may have C shaped profile in cross-section and the cam body 62 may have a raised bar on each side of the long axis of the cam body 72 that engages with the lip of the track 20 cross sectional profile. This allows for the engagement of the cam body 62 to the track 20 and provides wind resistance due to a catenary effect enabling high wind loads without the need for panel sections with high section modulus.

Figure 31:
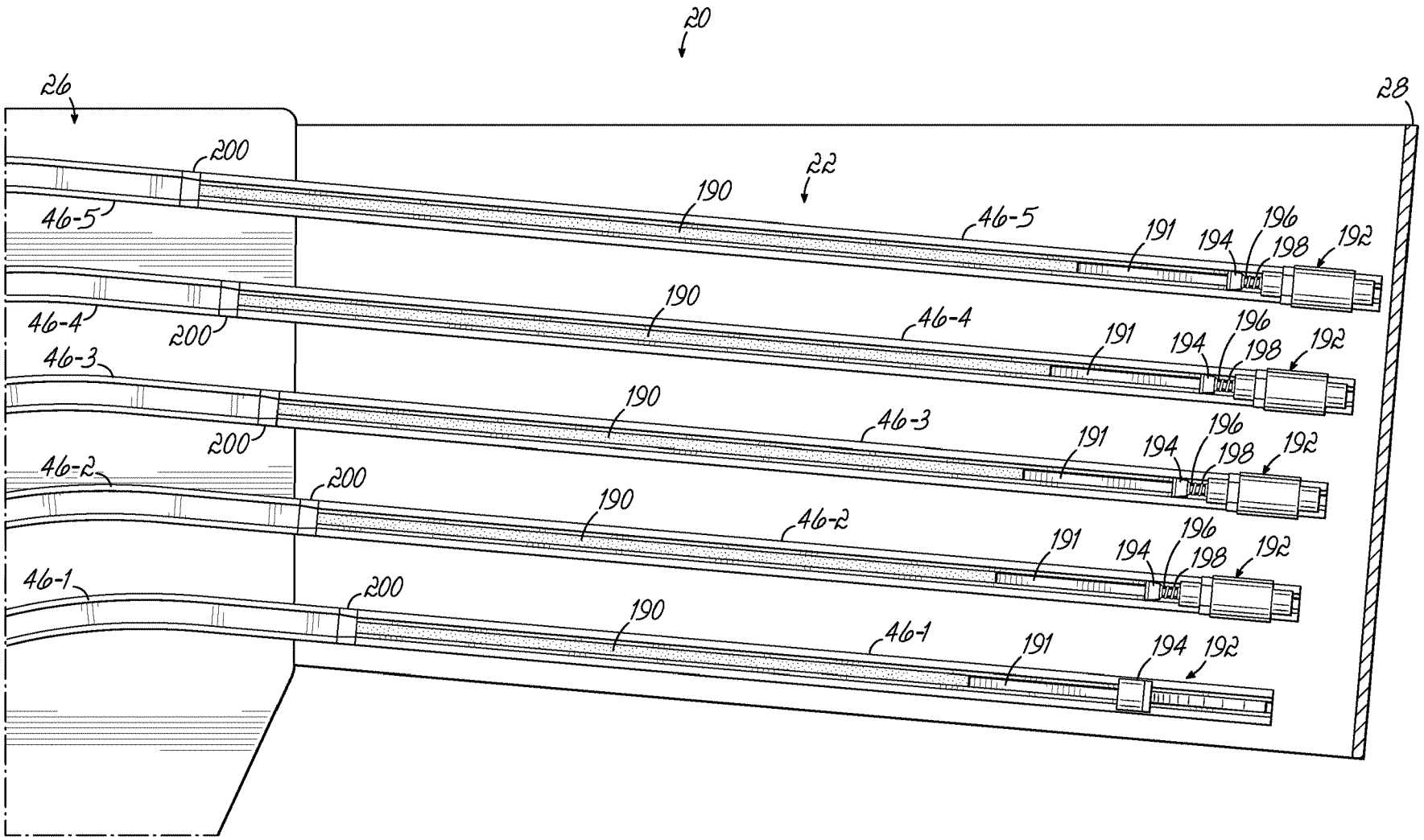
FIG. 31 is a side elevational view of a portion of the track system according to an alternative embodiment of this invention.

As each panel 16 rides in its dedicated track 46 into an open and horizontal position, the rollers 70*a*, 70*b*, 70*c* travel up the vertical section 24 to the transition section 26, whereby the panel 16 begins to disengage from the adjacent lower panel 16 and is moved into the horizontal section 22 of the track 20. The cross-sectional profiles of the horizontal and vertical track sections may differ to allow for the installation of inserts 190 and detents 191 within the horizontal tack sections 22. The horizontal track sections 22 and the transition track sections 26 may be joined together by a transition piece 200 as shown in FIG. 31. This transition piece 200 is to be placed between the track sections 22, 26 to guide the rollers 70*a*, 70*b*, 70*c*. This transition piece 200 allows for the variation of the cross sections of the two different track sections 22, 26.

When the panels 16 are traveling in the closing direction, the stabilizing roller 70*b* presses into the insert 190 to provide rolling resistance and prevent recoil during panel 16 pickup. The insert 190 is made of urethane in one embodiment of this invention to assist in the slowing movement of the panel 16 in the horizontal track section 22. As the panels 16 travel in the upward direction and are parked into the head position or door open configuration in the horizontal track section 22, a shock absorber or stop 192 maybe positioned proximate the end of the track section 22 as shown in FIG. 31 to slow and control any recoil of the panel 16. The stop 192 may be a simple rubber or other material bumper 194 as shown in the track 46-1 of FIG. 31 or the stop 192 may include the bumper 194 mounted on a translating shaft 196 biased by spring 198 concentrically mounted on the shaft 196 as shown on tracks 46-2 thru 46-5 of FIG. 31.

When the movement of the panel 16 stops in the horizontal track section 22 via the stop 192, the roller 70*a* then seats into a detent area 191 beyond the insert 190 to positively "park" the panel 16. The stop 192 and insert 190 are modular in design and may vary in shape; their design takes into consideration being able to configure/customize the arrangement of these components to account for a wide range of door sizes, panel weights as well as varying lengths of the horizontal track section 22.

The horizontal track sections 22 may be sloped downward from a true 'horizontal' position so that the cam assembly 66 contact is maximized and also to benefit from gravity to park panels 16 in a slow speed operation.

Figure 29:
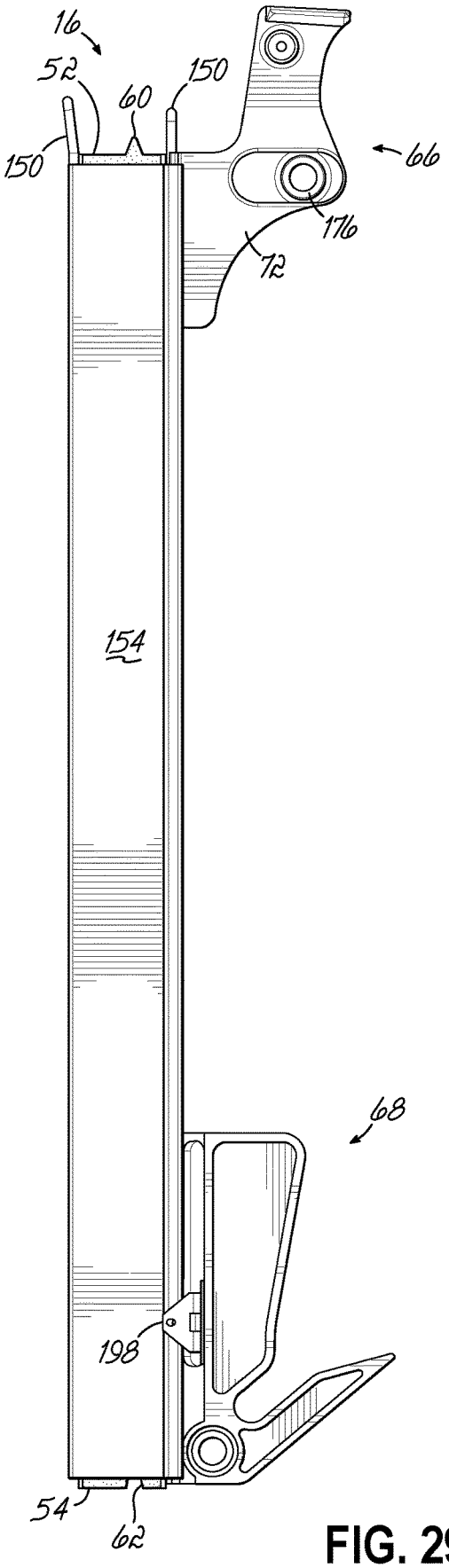
FIG. 29 is a side elevational view of the door panel of FIG. 27.
Figure 30:
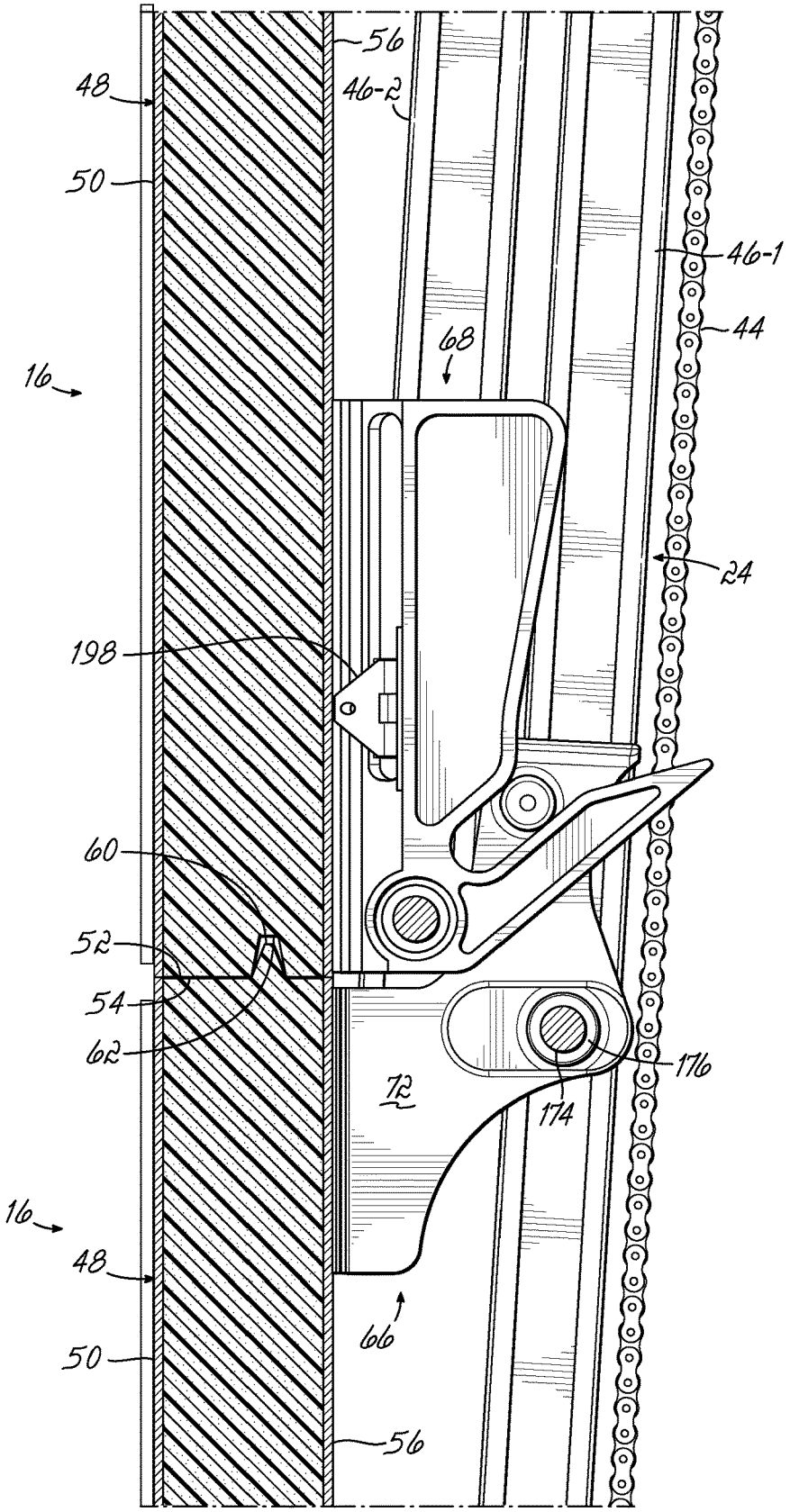
FIG. 30 is a side elevational, partially cross-sectioned view of adjacent door panels of the type shown in FIG. 27 coupled together via engaging hook and cam components in the door panels.

A further feature which may be included in the panel 16 of various embodiments of this invention is a panel lock 198 provided on the back of the hook assembly 68 to prevent the immediately superjacent panel 16 from sliding down past a lower panel 16 when the door 10 is closed. This panel lock 198 may be triangular shaped as shown in FIG. 29 and can be removed and/or flipped out of the way to allow for repair or replacement of a single panel 16 while the door is in the horizontal (open) position.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. An overhead sectional door for closing an opening when in a closed position, the door comprising:

a plurality of panels each arranged in a generally vertical orientation and stacked one upon another when in the closed position;

wherein each of the plurality of panels has a front face and at least a portion of the front face of each of the plurality of panels is coplanar with at least a portion of the front face of each of the other of the plurality of panels when the door is in the closed position;

wherein each of the plurality of panels is in a generally horizontal orientation and arranged in a stacked configuration when in an open position exposing the opening;

a track system operable to guide the plurality of panels to and from the closed position and the open position; and the track system further comprising a plurality of tracks each of which is associated with and guides one of the panels of the plurality of panels;

wherein the plurality tracks further comprise a plurality of vertical track pairs equal in number to the plurality of panels such that each of the vertical track pairs has only one of the plurality panels mounted thereto when the door is in the closed position.

2. The overhead sectional door of claim 1 wherein each track of the plurality of tracks has one of the panels of the plurality of panels dedicated thereto.

3. The overhead sectional door of claim 2 wherein each of the panels of the plurality of panels has one of the tracks of the plurality of tracks dedicated thereto.

4. The overhead sectional door of claim 1 wherein each track of the plurality of tracks further comprises a dedicated vertical track, a dedicated horizontal track and a dedicated transition track to guide movement of one of the panels of the plurality of panels to and from the closed position and the open position.

5. The overhead sectional door of claim 4 wherein the dedicated vertical track associated with a first one of the panels of the plurality of panels is longer than the dedicated vertical track associated with a second one of the panels of the plurality of panels, the second one of the panels being located above the first one of the panels in the overhead section door when in the vertical position.

6. The overhead sectional door of claim 1 wherein the plurality of panels are uncoupled one from another when the door is in the open position and the plurality of panels are in a generally horizontal portion of the track system.

7. The overhead sectional door of claim 1 further comprising:

a counterbalance system to assist movement of the plurality of panels to and from the open and closed positions.

8. The overhead sectional door of claim 7 wherein the counterbalance system further comprises one of the following: compression springs, extension springs, torsion springs and counterbalance weights.

9. The overhead sectional door of claim 8 wherein the counterbalance system further comprises at least one spring pack which includes a plurality of compression springs arranged in parallel with each other.

10. The overhead sectional door of claim 8 wherein the counterbalance system further comprises a pair of spring packs each comprising a plurality of compression springs and located on one side of the door.

11. The overhead sectional door of claim 1 further comprising:

a plurality of rollers each mounted to one of the plurality of panels for movement within the track associated with the panel to which the roller is mounted.

12. The overhead sectional door of claim 11 wherein the plurality of rollers further comprises at least one stabilizing roller having a stabilizing roller axis of rotation and at least one load-bearing roller having a load-bearing roller axis of rotation, wherein each of the at least one stabilizing roller and the at least one load-bearing roller are mounted to each one of the plurality of panels, wherein the stabilizing roller axis of rotation is generally perpendicular to the load-bearing axis of rotation.

13. The overhead sectional door of claim 1 wherein each of the tracks of the plurality of tracks further comprises two track portions which are each mounted proximate to the opening and on opposite ends of the associated panel of the plurality of panels.

14. The overhead sectional door of claim 13 wherein the two portions of each of the tracks of the plurality of tracks are generally mirror images of one another.

15. The overhead sectional door of claim 1 wherein the plurality of panels are each coupled to an adjacent panel when the door is in the closed position and the plurality of panels uncouple from one another as the door moves to the open position.

16. An overhead sectional door for closing an opening when in a closed position, the door comprising:

a plurality of panels each having a front face and arranged in a generally vertical orientation and stacked one upon another when in the closed position such that at least a portion of the front face of each of the plurality of panels is coplanar with at least a portion of the front face of each of the other of the plurality of panels;

wherein each of the plurality of panels is in a generally horizontal orientation and arranged in a stacked configuration when in an open position exposing the opening;

a track system operable to guide the plurality of panels to and from the closed position and the open position; and the track system further comprising a plurality of vertical track pairs equal in number to the plurality of panels and each of of the plurality of vertical track pairs is associated with and guides only one of the panels of the plurality of panels;

wherein each track of the plurality of tracks further comprises a dedicated vertical track, a dedicated horizontal track and a dedicated transition track to guide movement of one of the panels of the plurality of panels to and from the closed position and the open position.

17. The overhead sectional door of claim 16 wherein the plurality of panels are uncoupled one from another when the door is in the open position and the plurality of panels are in a generally horizontal portion of the track system.

18. The overhead sectional door of claim 16 further comprising:

a counterbalance system to assist movement of the plurality of panels to and from the open and closed positions, the counterbalance system further comprising one of the following: compression springs, extension springs, torsion springs and counterbalance weights.

19. The overhead sectional door of claim 18 further comprising:

a plurality of compression springs each contained within one of two spring packs with the compression springs arranged in parallel with each other.

20. The overhead sectional door of claim 16 further comprising:

a plurality of rollers each mounted to one of the plurality of panels for movement within the track associated with the panel to which the roller is mounted;

wherein the plurality of rollers further comprises at least one stabilizing roller having a stabilizing roller axis of rotation and at least one load-bearing roller having a load-bearing roller axis of rotation, wherein each of the at least one stabilizing roller and the at least one load-bearing roller are mounted to each one of the plurality of panels, wherein the stabilizing roller axis of rotation is generally perpendicular to the load-bearing axis of rotation.

21. The overhead sectional door of claim 16 wherein each of the tracks of the plurality of tracks further comprises two track portions which are each mounted proximate to the opening and on opposite ends of the associated panel of the plurality of panels;

wherein the two portions of each of the tracks of the plurality of tracks are generally mirror images of one another.

22. The overhead sectional door of claim 16 wherein the plurality of panels are each coupled to an adjacent panel when the door is in the closed position and the plurality of panels uncouple from one another as the door moves to the open position.

23. The overhead sectional door of claim 16 wherein the dedicated vertical track associated with a first one of the panels of the plurality of panels is longer than the dedicated vertical track associated with a second one of the panels of the plurality of panels; the second one of the panels is located above the first one of the panels in the overhead section door when in the vertical position.

24. An overhead sectional door for closing an opening when in a closed position, the door comprising:

a plurality of panels each arranged in a generally vertical orientation and stacked one upon another when in the closed position;

wherein each of the plurality of panels has a front face and at least a portion of the front face of each of the plurality of panels is coplanar with at least a portion of the front face of each of the other of the plurality of panels when the door is in the closed position;

wherein the plurality of panels is positioned above the opening when in an open position exposing the opening;

a track system operable to guide the plurality of panels to and from the closed position and the open position;

wherein the track system further comprises a plurality of vertical track pairs equal in number to the plurality of panels such that each of the vertical track pairs has only one of the plurality panels mounted thereto when the door is in the closed position; and a counterbalance system to assist movement of the plurality of panels to and from the open and closed positions, the counterbalance system further comprising one of the following: compression springs, extension springs, torsion springs and counterbalance weights.

25. The overhead sectional door of claim 24 further comprising:

a plurality of compression springs on opposite sides of the door and each contained within one of two spring packs with the compression springs arranged in parallel with each other.

26. An overhead sectional door for closing an opening when in a closed position, the door comprising:

a plurality of panels each arranged in a generally vertical orientation and stacked one upon another when in the closed position;

wherein the plurality of panels is positioned above the opening when in an open position exposing the opening;

a track system operable to guide the plurality of panels to and from the closed position and the open position;

wherein the track system further comprises a plurality of vertical track pairs equal in number to the plurality of panels such that each of the vertical track pairs has only one of the plurality panels mounted thereto when the door is in the closed position; and a plurality of rollers each mounted to one of the plurality of panels for movement within the track system;

wherein the plurality of rollers further comprises at least one stabilizing roller having a stabilizing roller axis of rotation and at least one load-bearing roller having a load-bearing roller axis of rotation, wherein each of the at least one stabilizing roller and the at least one load-bearing roller are mounted to each one of the plurality of panels, wherein the stabilizing roller axis of rotation is generally perpendicular to the load-bearing axis of rotation.

27. The overhead sectional door of claim 26 wherein each of the plurality of panels has a front face and at least a portion of the front face of each of the plurality of panels is coplanar with at least a portion of the front face of each of the other of the plurality of panels when the door is in the closed position.

* * * * *